US008554105B2

(12) United States Patent
Soda

(10) Patent No.: US 8,554,105 B2
(45) Date of Patent: Oct. 8, 2013

(54) IMAGE FORMING APPARATUS

(75) Inventor: Tomohisa Soda, Osaka (JP)

(73) Assignee: Kyocera Mita Corporation (JP)

( * ) Notice: Subject to any disclaimer, the term of this patent is extended or adjusted under 35 U.S.C. 154(b) by 194 days.

(21) Appl. No.: 13/312,452

(22) Filed: Dec. 6, 2011

(65) Prior Publication Data

US 2012/0148291 A1 Jun. 14, 2012

(30) Foreign Application Priority Data

Dec. 14, 2010 (JP) ..... 2010-278132

(51) Int. Cl.
*G03G 15/16* (2006.01)
*G03G 15/10* (2006.01)

(52) U.S. Cl.
USPC ..... 399/101; 399/237

(58) Field of Classification Search
USPC ..... 399/101, 237
See application file for complete search history.

(56) References Cited

U.S. PATENT DOCUMENTS

2004/0234309 A1 11/2004 Nagata et al.
2009/0016766 A1* 1/2009 Kamijo et al. ..... 399/101

FOREIGN PATENT DOCUMENTS

JP 2003-323058 11/2003
JP 2007-25028 2/2007
JP 2007-25029 2/2007
JP 2007-25030 2/2007

* cited by examiner

*Primary Examiner* — G. M. Hyder
(74) *Attorney, Agent, or Firm* — Gerald E. Hespos; Michael J. Porco; Matthew T. Hespos

(57) ABSTRACT

A wet type image forming apparatus has a primary transfer unit that transfers to an intermediate transfer body a coloring particle image formed on the surface of an image bearing member by using liquid developer. A secondary transfer unit transfers onto a recording medium the coloring particle image transferred to the intermediate transfer body. A cleaning unit recovers liquid developer remaining on the intermediate transfer body after transfer by the second transfer unit. An aggregation promoting agent addition unit is disposed on a downstream side of the secondary transfer unit in a direction of rotation of the intermediate transfer body and on an upstream side of the cleaning unit in a direction of rotation of the intermediate transfer body and adds to the surface of the intermediate transfer body an aggregation promoting agent that promotes aggregation of resin contained in the liquid developer.

8 Claims, 6 Drawing Sheets

IMAGE FORMING APPARATUS

BACKGROUND OF THE INVENTION

1. Field of the Invention

The present disclosure relates to an image forming apparatus.

2. Description of the Related Art

There are electrophotographic type image forming apparatuses, such as printers, copying machines, facsimile devices, and composite machines combining these functions, which use developing apparatus based on various different development methods. More specifically, for example, the developing methods are divided broadly into a dry developing method and a wet developing method, depending on the type of developer used. Of these, a developing apparatus based on a wet developing method employs a liquid developer in which toner particles and colored particles of pigment, or the like, are dispersed in a carrier liquid. In a developing apparatus using a wet developing method, charged coloring particles in the liquid developer move from the surface of a developing roller to the surface of a photosensitive drum, due to the principle of electrophoresis, and by this means, an electrostatic latent image formed on the surface of the photosensitive drum, which is an image carrier, is converted into a real image.

Furthermore, in an image forming apparatus which uses an electrophotographic method, if a developing containing coloring particles having relatively small particle size is used, then it is considered possible to form high-quality images having excellent tonality and high resolution. However, with a dry developer, the coloring particles tend to be scattered more readily in the air, if the coloring particles have a small particle size. On the other hand, in a liquid developer, coloring particles are distributed in a carrier liquid, and therefore it is possible to sufficiently suppress scattering of the coloring particles into the air. For this reason, it is desirable to use coloring particles having a small particle size, which cannot be adequately prevented from scattering when in a dry developer, for example, even microscopic coloring particles having an average particle size of the sub-micron order. Therefore, since an image forming apparatus equipped with a wet developing type of developing apparatus can use a liquid developer containing coloring particles of relatively small average particle size of this kind, then the formation of high-quality images having excellent tonality and high resolution can be expected.

Furthermore, among image forming apparatuses which use liquid developer, there are image forming apparatuses which include an intermediate transfer body, such as an intermediate transfer belt, for receiving the temporary transfer (primary transfer) of a coloring particle image which has been formed on a photosensitive drum, onto a circumferential surface of the belt, and then transferring the coloring particle image onto a recording medium (secondary transfer). An image forming apparatus which transfers a coloring particle image formed on a photosensitive drum, onto a recording medium, by means of an intermediate transfer body of this kind, recovers liquid developer remaining on the intermediate transfer belt after secondary transfer, from the intermediate transfer belt.

For example, apparatuses such as the following have been reported as image forming apparatuses of this kind.

Firstly, there has been reported a liquid developing electrophotographic apparatus using a liquid developer, in which a cleaning device for removing residual developer remaining on an intermediate transfer belt is provided to the upstream side of a developing apparatus and to the downstream side of a pressurization roller provided so as to oppose the intermediate transfer body in order to transfer a toner image onto a print medium, wherein the cleaning device includes: a carrier liquid application device which applies carrier liquid to the intermediate transfer body after transferring the image to the print medium; a bias voltage application device which applies a bias voltage of opposite polarity to the charging properties of the toner particles in the developer, to the intermediate transfer body; and a recovery device which recovers residual toner by removing, from the intermediate transfer body, carrier liquid that has been applied by the carrier liquid application device and liquid developer remaining on the intermediate transfer body which has not been transferred to the print medium.

Moreover, there has also been reported an image forming apparatus using a liquid developer having an intermediate transfer body, in which a liquid application member for applying liquid to the intermediate transfer body is provided between a secondary transfer position of transfer from the intermediate transfer body to a transfer medium and a cleaning position where a cleaning member abuts against the intermediate transfer body to the downstream side of the secondary transfer position in the direction of rotation of the intermediate transfer body.

Furthermore, there has also been reported an image forming apparatus using a liquid developer having an intermediate transfer body, in which a liquid application member for applying liquid having a lower viscosity than the carrier liquid to the intermediate transfer body is provided between a secondary transfer position of transfer from the intermediate transfer body to a transfer medium and a cleaning position where a cleaning member abuts against the intermediate transfer body to the downstream side of the secondary transfer position in the direction of rotation of the intermediate transfer body.

Moreover, there has also been reported an image forming apparatus using a liquid developer having an intermediate transfer body, in which a liquid application member for applying a portion of developer recovered by a cleaning member is provided between a secondary transfer position of transfer from the intermediate transfer body to a transfer medium and a cleaning position where the cleaning member abuts against the intermediate transfer body to the downstream side of the secondary transfer position in the direction of rotation of the intermediate transfer body.

As described previously, a liquid developer uses coloring particles having relatively small average particle size, in order to form an image of high quality. On the other hand, the smaller the particle size of the coloring particles, the greater the relative surface area and the higher the adhesive force acting on the intermediate transfer body, and the like. For this reason, in an image forming apparatus which includes an intermediate transfer body, it is considered that liquid developer is liable to remain on the intermediate transfer body after secondary transfer. Furthermore, the liquid developer remaining on the intermediate transfer body after secondary transfer is considered to affect image formation.

Therefore, in order to form images of high quality, it is necessary to be able to suitably clean away developer remaining on the intermediate transfer body after secondary transfer.

According to the first prior art apparatus described above, it is stated that aggregated or solidified liquid developer on the intermediate transfer body can be cleaned in an effective and stable manner.

Furthermore, according to the second to fourth prior art apparatuses described above, it is disclosed that adhering matter attached to the intermediate transfer body can be cleaned away easily.

However, in prior art image formation apparatuses such as those described above, there are cases where cleaning of the liquid developer remaining on the intermediate transfer body after secondary transfer is inadequate. For example, there are cases where cleaning of the liquid developer is inadequate, not only when using a liquid developer containing toner which includes a binding resin and a pigment, and the like, as the coloring particles, but also, for instance, when using a liquid developer in which a coloring material, such as pigment or the like, is dispersed in a carrier liquid in which resin is dissolved.

SUMMARY OF THE INVENTION

The present disclosure was devised in view of these circumstances, an object thereof being to provide an image forming apparatus whereby liquid developer remaining on an intermediate transfer body can be cleaned suitably after secondary transfer, and images of high quality can be formed.

The image forming apparatus relating to one aspect of the present embodiment includes: an image bearing member, on the surface of which an electrostatic latent image is formed; a developing apparatus which forms a coloring particle image in which the electrostatic latent image formed on the surface of the image bearing member is converted into a real image by using a liquid developer containing a carrier liquid, coloring particles dispersed in the carrier liquid, and resin dissolved in the carrier liquid; a rotatable intermediate transfer body which is disposed so as to oppose the image bearing member; a primary transfer unit which transfers the coloring particle image formed on the surface of the image bearing member to the intermediate transfer body; a secondary transfer unit which transfers onto a recording medium the coloring particle image transferred to the intermediate transfer body; a cleaning unit which recovers liquid developer remaining on the intermediate transfer body after transfer by the second transfer unit; and an aggregation promoting agent addition unit which is disposed on a downstream side of the secondary transfer unit in a direction of rotation of the intermediate transfer body and on an upstream side of the cleaning unit in a direction of rotation of the intermediate transfer body and which adds to the surface of the intermediate transfer body an aggregation promoting agent that promotes aggregation of resin contained in the liquid developer.

Further objects of the present disclosure and concrete advantages obtained by the present disclosure will become apparent from the following description of the embodiments.

DETAILED DESCRIPTION OF THE PREFERRED EMBODIMENTS

Figure 1:
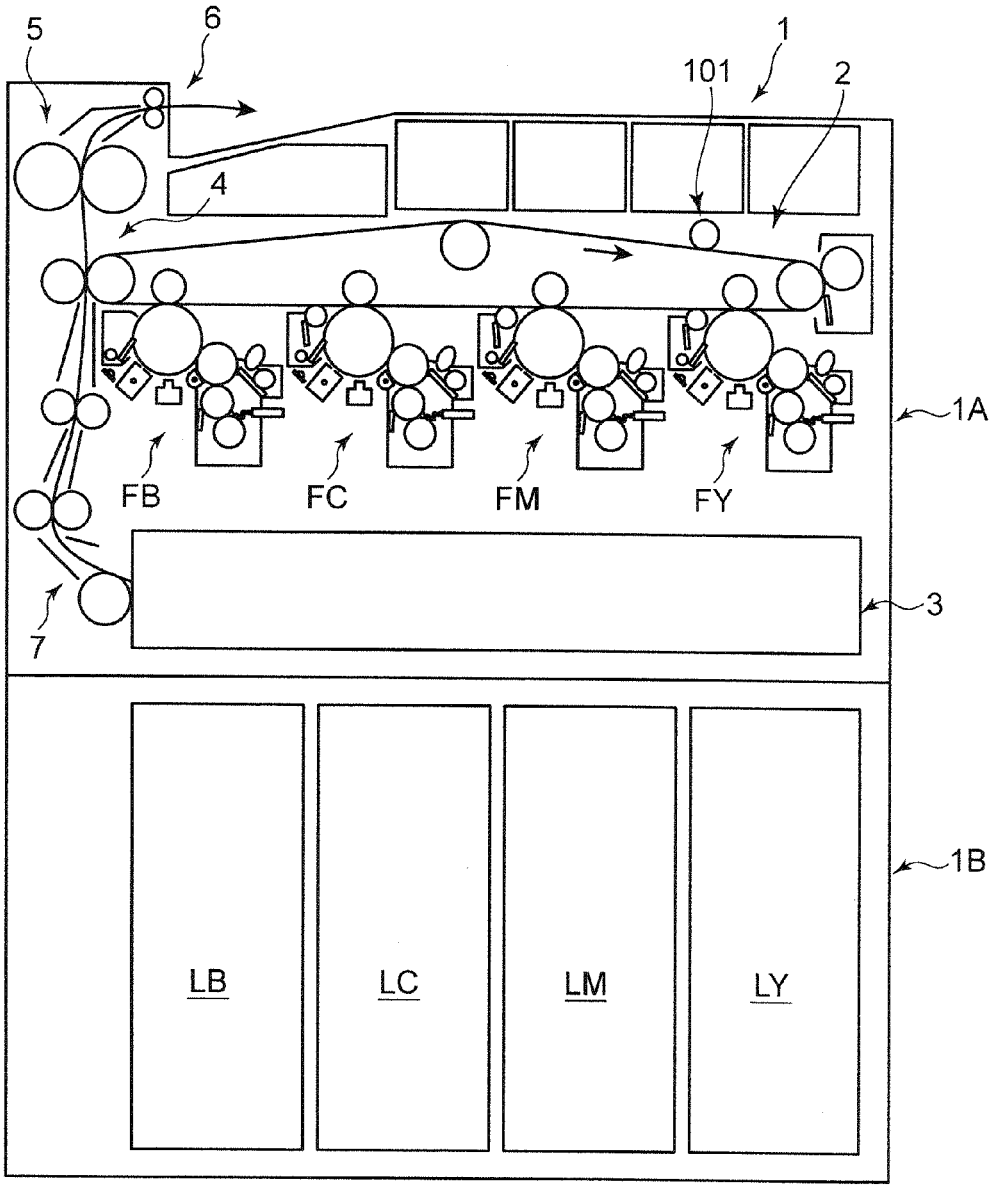
FIG. 1 is a schematic drawing showing the general composition of an image forming apparatus relating to the present embodiment.

Hereinafter, embodiments of the present disclosure are described, but the present disclosure is not limited to these embodiments.

The image forming apparatus relating to the present embodiment is an image forming apparatus including: an image bearing member on the surface of which an electrostatic latent image is formed; a developing apparatus which forms a coloring particle image that converts the electrostatic latent image formed on the surface of the image bearing member into a real image, by using a liquid developer containing a carrier liquid, coloring particles dispersed in the carrier liquid, and a resin dissolved in the carrier liquid; a rotatable intermediate transfer body which is disposed so as to oppose the image bearing member; a primary transfer unit which transfers a coloring particle image formed on the surface of the image bearing member, onto the intermediate transfer body; and a secondary transfer unit which transfers a coloring particle image that has been transferred to the intermediate transfer body, onto a recording medium. More specifically, the image forming apparatus relating to the present disclosure is, firstly, a wet type image forming apparatus which uses a liquid developer. The image forming apparatus relating to the present embodiment is a so-called tandem type image forming apparatus which includes an intermediate transfer body. Moreover, the image forming apparatus relating to the present embodiment is a wet type image forming apparatus of the tandem type described above, which includes a cleaning unit that recovers liquid developer remaining on the intermediate transfer body after transfer by the secondary transfer unit; and an aggregation promoting agent addition unit which adds an aggregating promoting agent that promotes aggregation of resin contained in the liquid developer, to the surface of the intermediate transfer body, and which is disposed to the downstream side of the secondary transfer unit in terms of the direction of rotation of the intermediate transfer body and to the upstream side of the cleaning unit in terms of the direction of rotation of the intermediate transfer body.

An image forming apparatus of this kind is able to perform suitable cleaning of liquid developer which is remaining on the intermediate transfer body after secondary transfer. Therefore, it is possible to provide an image forming apparatus which can form images of high quality.

This is thought to be because of the following reasons.

An aggregation promoting agent which promotes aggregation of the resin contained in the liquid developer is added to the surface of the intermediate transfer body by the aggregation promoting agent addition unit which is disposed to the downstream side of the secondary transfer unit in terms of the direction of rotation of the intermediate transfer body and to the upstream side of the cleaning unit in terms of the direction of rotation of the intermediate transfer body. In so doing, the aggregation promoting agent is added to the liquid developer remaining on the intermediate transfer body after secondary transfer, and the resin contained in the liquid developer is thereby aggregated. When the resin aggregates, the coloring particles and the like, are also incorporated and aggregated with the resin. The resin incorporated and aggregated with coloring particles, and the like, in this way can be recovered readily by the cleaning unit. More specifically, it is thought that even coloring particles having small particle size and high adhesive force against the intermediate transfer body can be recovered by the cleaning unit together with the aggregated resin.

Therefore, it is possible to perform suitable cleaning of liquid developer which is remaining on the intermediate transfer body after secondary transfer.

Below, the image forming apparatus relating to the present embodiment is described with reference to the drawings.

The terms indicating the directions "up", "down", "left" and "right" used in the following description are simply intended to clarify the explanation, and do not in any way limit the present disclosure.

Figure 2:
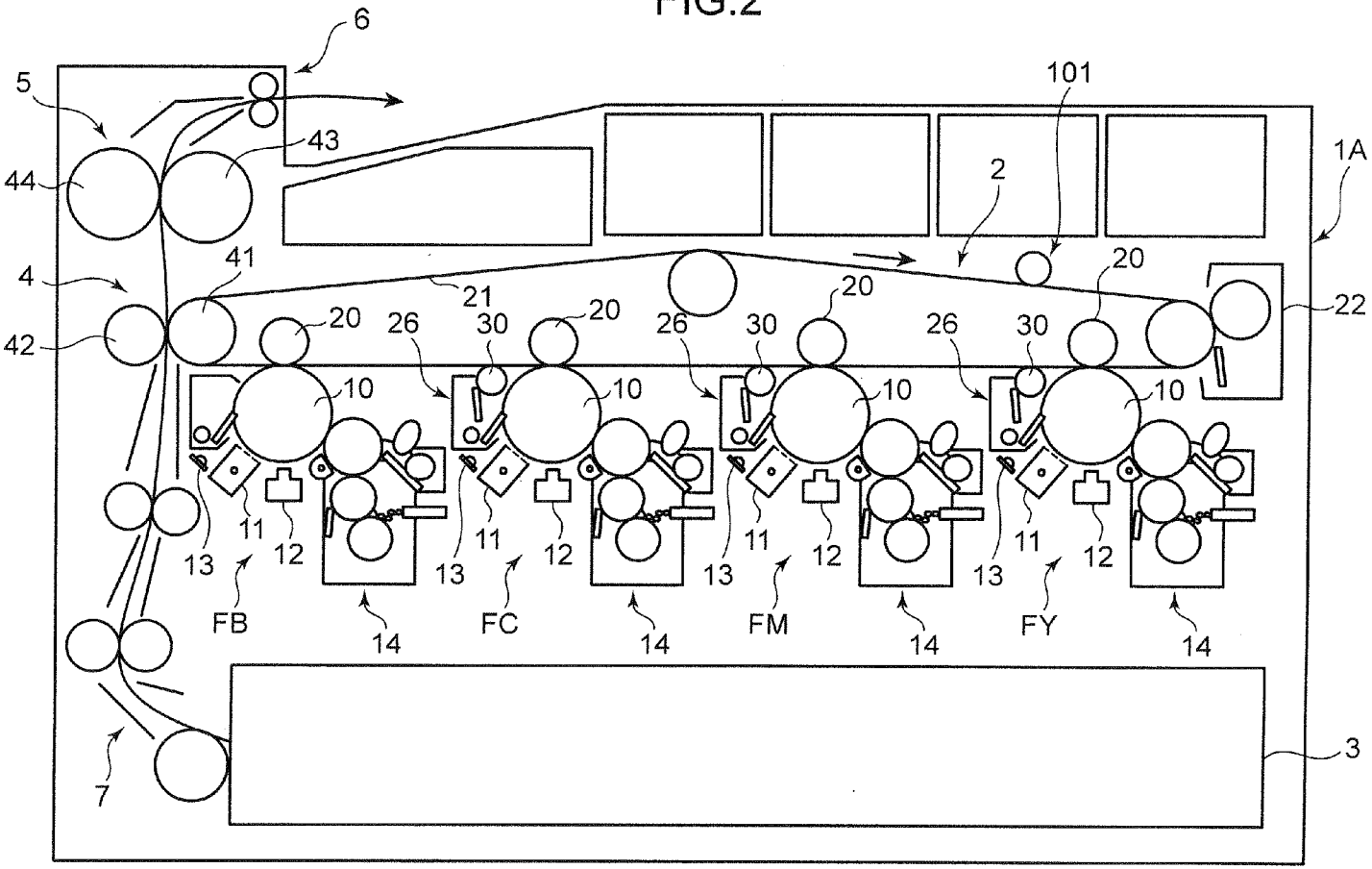
FIG. 2 is a schematic drawing of an image forming apparatus, excluding the liquid developer circulation apparatus.

FIG. 1 is a schematic drawing showing the general composition of an image forming apparatus (wet type image forming apparatus) relating to the present embodiment. FIG. 2 is a schematic drawing of an image forming apparatus, excluding a liquid developer circulation apparatus. The image forming apparatus shown in FIG. 1 and FIG. 2 is a color printer, but is not subject to particular restrictions, provided that it is a wet type image forming apparatus capable of forming an image on a recording medium. More specifically, the image forming apparatus may be a copying device, a facsimile device or a composite device (MFP : multi-function printer) combining these functions. Furthermore, there are no particular restrictions on the recording medium used in the description given below, provided that it is possible to form an image on the surface thereof. More specifically, the recording medium may be copy paper, tracing paper, card, OHP sheet, or the like. In the following descriptions, paper is given as an example of the recording medium.

As shown in FIG. 1, the image forming apparatus (color printer) 1 is constituted by an upper side main body section (apparatus main body) 1A in which various units and components for image formation are accommodated, and a lower side main body section 1B which is situated below the upper side main body section 1A and in which liquid developer circulation apparatuses LY, LM, LC, LB for respective colors are accommodated. Here, the pipework which links between the upper side main body section 1A and the lower side main body section 1B is omitted from the drawings.

Furthermore, as shown in FIG. 2, the upper side main body section 1A includes: a tandem type image formation section 2 which forms a coloring particle image; a paper accommodation unit 3 which accommodates the paper; a secondary transfer unit 4 which transfers a coloring particle image formed by the image formation section 2, onto paper; a fixing unit 5 which fixes the transferred but unfixed coloring particle image onto the paper; an output unit 6 which outputs paper on which the coloring particular image has been fixed thereby forming an image, to the exterior of the device; and a paper conveyance unit 7 which conveys the paper from the paper accommodation unit 3 to the paper output unit 6.

Furthermore, as described above, the fixing unit 5 in the image forming apparatus is generally provided between the secondary transfer unit 4 and the output unit 6. If the liquid developer used has high fixing properties, then this fixing unit 5 may be omitted. In this case, it is also possible to provide conveyance rollers, instead of the fixing unit 5.

The image formation section 2 includes an intermediate transfer body (intermediate transfer belt) 21, a cleaning unit 22 for the intermediate transfer belt 21, an aggregation promoting agent addition unit 101, and image formation units FY, FM, FC and FB which correspond respectively to the colors of yellow (Y), magenta (M), cyan (C) and black (Bk).

The intermediate transfer belt 21 is an endless belt member having electrically conductive properties. The intermediate transfer belt 21 has a greater width than the paper of greatest length in the direction perpendicular to the paper conveyance direction, of the paper on which images are formed. Furthermore, the intermediate transfer belt 21 is driven to revolve in a clockwise direction in FIG. 1 and FIG. 2. The surface of the intermediate transfer belt 21 which faces outwards when the intermediate transfer belt 21 revolves is called the "front surface" and the surface facing inwards is called the "rear surface".

The four image formation units FY, FM, FC and FB are aligned in close proximity to the intermediate transfer belt 21, and are arranged between the cleaning unit 22 of the intermediate transfer belt 21 and the secondary transfer unit 4. The arrangement sequence of the image formation units FY, FM, FC and FB is not limited to that shown, but the diagram shows one desirable arrangement from the viewpoint of lessening the effects of mixing between the different colors on the final image.

The image formation units FY, FM, FC and FB each include: a photosensitive drum 10, which is an image bearing member; a charging apparatus 11, an exposure apparatus 12, a developing apparatus 14, a primary transfer roller 20, a cleaning apparatus 26, a charge removing apparatus 13, and a carrier liquid removing roller 30. Of the image formation units FY, FM, FC and FB, a carrier liquid removing roller 30 is not provided in the black image formation unit FB which is arranged in the closest position to the secondary transfer unit 4, but apart from this, the composition is the same in each of the image formation units.

Liquid developer circulation apparatuses LY, LM, LC and LB are provided respectively for each of the image forming units FY, FM, FC and FB, so as to supply and recover the liquid developers of the respective colors. The image formation units FY, FM, FC and FB are described in detail below.

The photosensitive drum 10 is an image bearing member having a round cylindrical shape, which is capable of carrying a charged (charged as a positive electrode) coloring particle image on the surface (circumferential surface) thereof. Furthermore, the photosensitive drum 10 depicted here is able to rotate in the counter-clockwise direction.

The charging apparatus 11 uniformly charges the surface of the photosensitive drum 10.

The exposure apparatus 12 irradiates light onto the surface of the photosensitive drum 10 which has been uniformly charged, on the basis of image data, for example, image data which is input from an external device. By this means, an electrostatic latent image based on image data is formed on the surface of the photosensitive drum 10. A possible example of the exposure apparatus 12 is: an LED exposure apparatus which is an exposure apparatus having an LED as a light source, for example.

The developing apparatus 14 causes coloring particles to adhere to the electrostatic latent image, by holding liquid developer so as to oppose the electrostatic latent image formed on the surface of the photosensitive drum 10. By this means, the electrostatic latent image is developed (converted into a real image), as a coloring particle image. The developing apparatus 14 is described in detail below.

The primary transfer roller 20 is disposed on the rear surface of the intermediate transfer belt 21 so as to oppose the photosensitive drum 10. Furthermore, a voltage of opposite polarity to the coloring particles which constitute the coloring particle image (in the present embodiment, negative polarity) is applied to the primary transfer roller 20 from a power supply, which is not illustrated. More specifically, the primary transfer roller 20 applies a voltage of opposite polarity to the coloring particles, to the intermediate transfer belt 21, at the position where the roller 20 makes contact with the intermediate transfer belt 21. Since the intermediate transfer belt 21 has electrical conductivity, coloring particles are drawn to the surface of the intermediate transfer belt 21 and the periphery thereof, by this applied voltage. The intermediate transfer belt 21 functions as an intermediate transfer body which carries a color particle image and conveys the image to the paper.

The cleaning apparatus 26 is an apparatus for cleaning liquid developer which remains on the photosensitive drum 10 without being transferred to the intermediate transfer belt 21. Furthermore, the cleaning apparatus 26 includes a liquid developer conveyance screw 261 and a cleaning blade 262.

A liquid developer conveyance screw 261 which is disposed inside the cleaning apparatus 26 conveys the remaining developer, which has been scraped away by the cleaning blade 262 and accommodated in the cleaning apparatus 26, to the outside of the cleaning apparatus 26.

The cleaning blade 262 is a plate-shaped member which extends in the rotational axis direction of the photosensitive drum 10, so as to scrape away liquid developer remaining on the surface of the photosensitive drum 10. One end portion of the cleaning blade 262 slides in contact with the surface of the photosensitive drum 10 and scrapes away liquid developer remaining on the photosensitive drum 10 as the photosensitive drum 10 rotates.

The charge removing apparatus 13 has a charge removing light source, and removes charge from the surface of the photosensitive drum 10 by means of light from the light source, after the removal of liquid developer by the cleaning blade 262, in preparation for image formation in the next revolution of the drum.

The carrier liquid removal roller 30 is a substantially round bar-shaped member which is rotatable in the same direction as the photosensitive drum 10 about an axis of rotation which is parallel to the axis of rotation of the photosensitive drum 10. Furthermore, the carrier liquid removal roller 30 is disposed toward the side where the secondary transfer unit 4 is provided, from the position of contact between the photosensitive drum 10 and the intermediate transfer belt 21, and removes carrier liquid from the surface of the intermediate transfer belt 21.

The paper accommodation unit 3 is a section which accommodates paper on which a coloring particle image is fixed. The paper accommodation unit 3 is disposed below the upper side main body section 1A. Furthermore, the paper accommodation unit 3 includes a paper supply cassette (not illustrated) which is formed so as to be able to accommodate paper.

The secondary transfer unit 4 is a section which transfers the coloring particle image formed on the intermediate transfer belt 21, onto paper. Moreover, the secondary transfer unit 4 has a supporting roller 41 which supports the intermediate transfer belt 21, and a secondary transfer roller 42 which is disposed so as to oppose the supporting roller 41.

The fixing unit 5 is a section which fixes a toner image onto the paper. The fixing unit 5 is disposed to the upstream side of the secondary transfer unit in terms of the direction of conveyance of the paper, and in the present embodiment, is disposed to the upper side of the secondary transfer unit. Furthermore, the fixing unit 5 includes a heating roller 43, and a pressurization roller 44 which is arranged so as to oppose the heating roller 43.

Furthermore, if the liquid developer used has high fixing properties, as described above, then this fixing unit 5 may be omitted. In this case, it is also possible to provide a conveyance roller pair, instead of the heating roller or pressurization roller which constitute the fixing unit 5. Furthermore, in a case of this kind, the coloring particle image is fixed in the secondary transfer unit 4 after being transferred.

The output unit 6 is a section where the paper sheet on which the coloring particle image has been fixed by the secondary transfer unit 4 or the fixing unit 5 is output. The output unit 6 is arranged in the upper portion of the color printer 1.

The paper conveyance unit 7 includes a plurality of conveyance roller pairs, and conveys paper from the paper accommodation unit 3, via the secondary transfer unit 4 and the fixing unit 5, to the output unit 6.

The cleaning unit 22 of the intermediate transfer belt 21 is a section which recovers the liquid developer remaining on the intermediate transfer belt 21 after the coloring particle image on the intermediate transfer belt 21 has been transferred to the recording medium in the secondary transfer unit 4. Furthermore, the cleaning unit 22 of the intermediate transfer belt 21 is arranged to the downstream side of the secondary transfer unit 4 in terms of the direction of rotation of the intermediate transfer belt 21 and to the upstream side of the image formation units FY, FM, FC and FB of the image forming section, in terms of the direction of rotation of the intermediate transfer belt 21.

The aggregation promoting agent addition unit 101 is a section which adds an aggregation promoting agent to the surface of the intermediate transfer belt 21. Furthermore, the aggregation promoting agent addition unit 101 is disposed to the downstream side of the secondary transfer unit 4 in terms of the direction of rotation of the intermediate transfer belt 21 and to the upstream side of the cleaning unit 22 of the intermediate transfer belt 21 in terms of the direction of rotation of the intermediate transfer belt 21. More specifically, the aggregation promoting agent addition unit 101 is disposed between the secondary transfer unit 4 and the cleaning unit 22 of the intermediate transfer belt 21. By adding the aggregation promoting agent to the surface of the intermediate transfer belt 21 by means of the aggregation promoting agent addition unit 101, it is possible to recover the liquid developer remaining on the intermediate transfer belt 21 efficiently by means of the cleaning unit 22 of the intermediate transfer belt 21.

Figure 3:
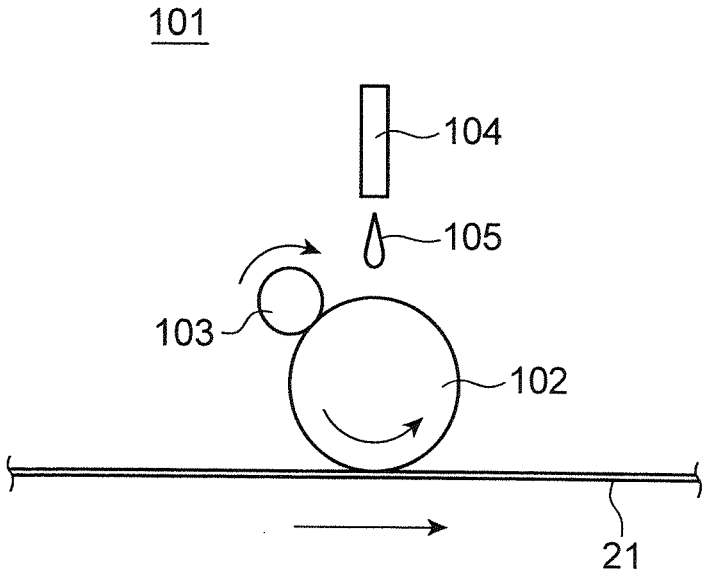
FIG. 3 is a schematic drawing showing the structure of an aggregation promoting agent addition unit provided in the image forming apparatus relating to the present embodiment.

Furthermore, the aggregation promoting agent addition unit 101 includes an application roller 102, a bubble smoothing roller 103 and a supply nozzle 104, as shown in FIG. 3. FIG. 3 is a schematic drawing showing a composition of the aggregation promoting agent addition unit provided in the image forming apparatus relating to the present embodiment.

The supply nozzle 104 supplies the aggregation promoting agent 105 to the circumferential surface of the application roller 102.

The application roller 102 is disposed rotatably in accordance with the rotation of the intermediate transfer belt 21, in such a manner that the circumferential surface thereof makes contact with the intermediate transfer belt 21. By this means, the application roller 102 can apply the aggregation promoting agent 105 supplied from the supply nozzle 104, to the surface of the intermediate transfer belt 21. The application roller 102 may also be disposed rotatably in accordance with the rotational speed of the intermediate transfer belt 21, in such a manner that the circumferential surface lies in close proximity to the intermediate transfer belt 21.

The bubble smoothing roller 103 is arranged rotatably in accordance with the rotation of the application roller 102, in such a manner that the circumferential surface thereof makes contact with the application roller 102. Furthermore, the bubble smoothing roller 103 is arranged in a position to the downstream side of the supply position of the aggregation promoting agent from the supply nozzle 104 and to the upstream side of the contact position between the application roller 102 and the intermediate transfer belt 21. By means of the bubble smoothing roller 103 rotating in contact with the application roller 102 at this position, it is possible to suppress bubbling of the aggregation promoting agent 105 which has been supplied onto the circumferential surface of the application roller 102. Furthermore, the bubble smoothing roller 103 is able to spread the aggregation promoting agent 105 uniformly over the circumferential surface of the application roller 102.

There are no particular restrictions on the aggregation promoting agent, provided that it is capable of promoting aggregation of the resin included in the liquid developer. By applying an aggregation promoting agent of this kind to the surface of the intermediate transfer belt 21 by means of the aggregation promoting agent addition unit 101, it is possible suitably to recover the liquid developer remaining on the intermediate transfer belt 21 after secondary transfer, by means of the cleaning unit 22 of the intermediate transfer belt 21.

More specifically, it is preferable to use a liquid in which the resin is insoluble, as the aggregation promoting agent. More preferably, the aggregation promoting agent is a liquid which is mutually dissolvable with the carrier liquid contained in the liquid developer. Specifically, it is preferable that the aggregation promoting agent has high compatibility with the carrier liquid included in the liquid developer.

In the present specification, insoluble means that the object being dissolved, in this case, the resin, is hardly dissolved at all. Furthermore, an insoluble liquid means a liquid in which the object being dissolved, in this case, the resin, is hardly dissolved at all, and which promotes aggregation of the resin contained in the liquid developer by being added to the liquid developer. Moreover, insolubility is defined by comparison with solubility, and an insoluble liquid is a liquid which has lower solubility than when using a soluble liquid. Furthermore, mutually soluble means that when liquids of two types are mixed together in any combination ratio, they mix together and dissolve uniformly.

According to the configuration of the present embodiment, it is possible to perform suitable cleaning of liquid developer which is remaining on the intermediate transfer body after secondary transfer.

This is thought to be because of the following reasons.

When the aggregation promoting agent is a so-called poor solvent with respect to resin, which causes the resin dissolved in the liquid developer to aggregate, when added to the liquid developer. Therefore, by adding the aggregation promoting agent to the liquid developer remaining on the intermediate transfer body after secondary transfer, it is possible to cause the aggregation of resin dissolved in the liquid developer to proceed more appropriately. Furthermore, if the aggregation promoting agent is added to the liquid developer remaining on the intermediate transfer body after secondary transfer, then the aggregation promoting agent can be distributed uniformly in the liquid developer. Therefore, it is possible to better display the beneficial effects of aggregating the resin dissolved in the liquid developer.

Furthermore, as described above, the liquid developer contains a carrier liquid, coloring particles dispersed in the carrier liquid, and resin which is dissolved in the carrier liquid. The liquid developer includes carrier liquid, coloring particles and resin, and is not subject to particular restrictions provided that it can be used as a liquid developer. More specific examples of the liquid developer are given below.

A first example of the liquid developer, for instance, is a liquid developer containing carrier liquid, coloring particles dispersed in the carrier liquid, and resin dissolved in the carrier liquid, in which the resin contains a cellulose ether type resin.

The cellulose ether type resin is preferably ethyl cellulose. The content of cellulose ether type resin is preferably 1 to 6 parts by mass per 100 parts by mass of the liquid developer.

Furthermore, the carrier liquid preferably includes tall oil fatty acid. The content of tall oil fatty acid is preferably 20 to 90 parts by mass per 100 parts by mass of the liquid developer.

The carrier liquid serves as a liquid carrier, which is used with the object of raising the electrical insulating properties of the obtained liquid developer. There are no particular restrictions on the carrier liquid, provided that it has electrical insulating properties and can be used as a carrier liquid for the liquid developer. A more specific example is, for instance, an organic solvent, or the like, having a volumetric resistivity at 25° C. of no less than 1010 Ω·cm, in other words, an electrical conductivity of no more than 100 pS/cm. There are no particular restrictions on the carrier liquid, but it is desirable to use an aliphatic hydrocarbon which is liquid at room temperature, such as fluid paraffin, for instance. Specific examples of the aliphatic hydrocarbon are a paraffin type hydrocarbon, such as an n-paraffin type hydrocarbon or an iso-paraffin type hydrocarbon, or a halogenated aliphatic hydrocarbon, or the like. Specific examples of the paraffin hydrocarbon include, for instance, n-hexane, n-heptane, n-octane, nonane, decane, dodecane, cyclohexane, and the like. Furthermore, the halogenated aliphatic hydrocarbon may be, for instance, perchloroethylene, trichloroethane, or the like. In the carrier liquid, it is possible to use the organic solvents constituting the respective carrier liquids given as examples above, either independently, or in a combination of two or more types. As described above, it is desirable to use a carrier liquid which includes an aliphatic hydrocarbon that is liquid at room temperature, such as fluid paraffin, and more preferably, to use a carrier liquid which includes an aliphatic hydrocarbon having a branched chain.

Furthermore, it is possible to use a commercially marketed carrier liquid. More specific examples are: Isopar G, Isopar H, Isopar K, Isopar L, Isopar M and Isopar V made by Exxon Mobil Corp., fluid paraffin "Moresco White P-40", "Moresco White P-70" and "Moresco White P-200" made by Moresco Corp., fluid paraffin "Cosmo White P-60", "Cosmo White P-70" and "Cosmo White P-120" made by Cosmo Oil Co., Ltd., and the like.

Furthermore, the carrier liquid which can be used here is preferably a liquid that is capable of dissolving cellulose ether type resin (a liquid in which the solubility of cellulose ether type resin is relatively high), in addition to the properties described above. The carrier liquid of this kind may be, for instance, oil such as vegetable oil, animal oil, or mineral oil, and of these vegetable oil is preferable. Furthermore, among vegetable oils, a tall oil fatty acid (main component: oleic acid, linoleic acid) is preferable, as stated above.

Moreover, there are no particular restrictions on the carrier liquid, provided that the cellulose ether type resin is dissolved in the carrier liquid. The carrier liquid may employ only a liquid in which the solubility of cellulose ether type resin is relatively high (a good solvent for cellulose ether type resin), or a mixture of a good solvent for cellulose ether type resin and a liquid in which the solubility of cellulose ether type resin is relatively low (a poor solvent for cellulose ether type resin). In this case, care is taken in such a manner that the conductivity of the whole carrier liquid and hence the conductivity of the liquid developer does not become too high, depending on the type of the carrier liquid used. For instance, tall oil fatty acids, and other vegetable oils, animal oils and mineral oils, generally have high conductivity compared to aliphatic hydrocarbons, such as fluid paraffin. Therefore, in order to dissolve the cellulose ether type resin satisfactorily in the carrier liquid, it is necessary to pay close attention to the content of the aforementioned oils if such oils are included in a carrier liquid.

The greater the content of the oils in the carrier liquid as a whole, the more beneficial from the viewpoint of the solubility of the cellulose ether type resin, but the more disadvantageous from the viewpoint of electrical conductivity. On the other hand, the smaller the content of the oils in the carrier liquid as a whole, the more beneficial from the viewpoint of electrical conductivity, but the more disadvantageous from the viewpoint of the solubility of the cellulose ether type resin. The content of the oil varies depending on the type of the cellulose ether type resin and the content, and the like, in the liquid developer, but is preferably 20 to 90 parts by mass, more preferably, 30 to 80 parts by mass, and even more preferably, 40 to 70 parts by mass, per 100 parts by mass of liquid developer. If the content of the oil is too small, then it tends to become difficult to dissolve the cellulose ether type resin satisfactorily in the carrier liquid. Furthermore, if the content of the oil is too large, then there is a tendency for the conductivity of the whole carrier liquid, and hence the conductivity of the liquid developer, to become too high. If the conductivity of the liquid developer is too high, then the developing properties are insufficient, the image density becomes low and there is a possibility of increased fogging.

The conductivity of the liquid developer is preferably, 200 pS/cm or less, for instance. Consequently, it is desirable to adjust the conductivity of the whole carrier liquid, and hence the conductivity of the liquid developer to 200 pS/cm or lower, by dissolving the cellulose ether type resin in the oil, such as tall oil fatty acid, and mixing an aliphatic hydrocarbon having high electrical resistance with the solution thus obtained (in the present specification, called "resin solution").

For the coloring particles, it is possible to use a toner in which pigment is dispersed in a binding resin, or the pigment itself. For a pigment of this kind, it is possible to use, for instance, commonly known organic pigment or inorganic pigment, without any particular restrictions.

For example, as a black pigment, it is possible to use: carbon black, oil furnace black, channel black, lamp black, acetylene black, an azine coloring material such as aniline black, or the like, a metallic salt azo coloring material, a metal oxide, a complex metal oxide, or the like. For a yellow pigment, it is possible to use: Cadmium Yellow, Mineral Fast Yellow, Nickel Titanium Yellow, Naples Yellow, Naphthol Yellow S, Hansa Yellow G, Hansa Yellow 10G, Benzidine Yellow GR, Quinoline Yellow Lake, Permanent Yellow NCG, Tartrazine Lake, and the like. As an orange pigment, it is possible to use: Molybdenum Orange, Permanent Orange GTR, Pyrazolone Orange, Vulcan Orange, Indanthrene Brilliant Orange RK, Benzidine Orange G, Indanthrene Brilliant Orange GK, and the like. Possible examples of red pigment are: Bengala, Cadmium Red, Permanent Red 4R, Lithol Red, Pyrazolone Red, Watching Red Calcium salt, Lake Red D, Brilliant Carmine 6B, Eosine Lake, Rodamine Lake B, Alizarin Lake, Brilliant Carmine 3B, and the like. Possible examples of a violet pigment are: Fast Violet B, Methyl Violet Lake, and the like. Possible examples of a blue pigment are: C.I. Pigment Blue 15:3, Cobalt Blue, Alkali Blue, Victoria Blue Lake, Phthalocyanine Blue, Nonmetallic Phthalocyanine Blue, Phthalocyanine Blue partial salt compound, Fast Sky Blue, Indanthrene Blue BC, and the like. Possible example of a green pigment are: Chrome Green, Chrome Oxide, Pigment Green B, Malachite Green Lake, and the like.

The content of pigment in the liquid developer is preferably 1 to 30 mass %. More preferably, the pigment content is no less than 3 mass % and even more preferably, no less than 5 mass %. More preferably, the pigment content is no more than 20 mass % and even more preferably, no more than 10 mass %.

The average particle size of the pigment in the liquid developer, and more specifically, the volume standard median size (D50) is preferably 0.1 to 1.0 μm. If the average particle size of the pigment is too small, then the developing properties are insufficient, the image density becomes low and there is a possibility of increased fogging. Furthermore, if the average particle size of the pigment is too large, then there is a possibility of decline in the fixing properties. Here, the volume standard median diameter (D50) generally means the particle diameter at the 50% point of a cumulative curve in which the total volume of one group of particles for which a particle size distribution has been determined is taken as 100%.

Furthermore, a liquid developer of this kind may include a dispersion stabilizer for promoting and stabilizing the dispersion of particles in the liquid developer. A suitable dispersion stabilizer is, for example, "BYK-116" or the like. It is also desirable to use "Solsperse 9000", "Solsperse 11200", "Solsperse 13940", "Solsperse 16000", "Solsperse 17000" or "Solsperse 18000" made by Lubrizol Corp., or "Antaron (registered trademark) V-216" or "Antaron (registered trademark) V-220" made by ISP, or the like.

The content of dispersion stabilizer in the liquid developer is approximately 1 to 10 mass %, and preferably 2 to 6 mass %.

The cellulose ether type resin is a polymer in which the hydroxyl groups in the cellulose molecules are substituted with an alkoxy group. There are no particular restrictions on the substitution rate, but is preferably 45 to 49.5%, for example. Furthermore, it is also possible to substitute the alkyl part of the alkoxy group with a hydroxyl group, or the like. A coating formed by the cellulose ether type resin has excellent tenacity, thermal stability, and the like.

The cellulose ether type resin preferably has the following properties. Firstly, it is preferable that the cellulose ether type resin can exist stably for a long period of time in a dissolved state in the carrier liquid. Moreover, it is preferebale, if the concentration of the cellulose ether type resin in the carrier liquid becomes high on the surface of the recording medium after the transfer of the image to the recording medium, and exceeds a saturation solubility amount, then the cellulose ether type resin is able to collect on the surface of the recording medium and form a coating. Possible examples of the cellulose ether type resin are: an alkyl cellulose such as methyl cellulose, ethyl cellulose, or the like; a hydroxyalkyl cellulose such as hydroxyethyl cellulose, hydroxypropyl cellulose, or the like; a hydroxyalkyl alkyl cellulose such as hydroxyethyl methyl cellulose, hydroxypropyl methyl cellulose, hydroxyethyl ethyl cellulose, or the like; a carboxyalkyl cellulose such as carboxymethyl cellulose; and a carboxyalkyl hydroxyalkyl cellulose such as carboxymethyl hydroxyethyl cellulose, or the like. These resins may be used independently, or two or more types of the resins may be used in combination, depending on the circumstances. Of these resins, from the viewpoint of reliably obtaining a liquid developer having excellent fixing properties without consuming thermal energy or light energy, an alkyl cellulose is desirable, and of the alkyl celluloses, ethyl cellulose is desirable.

It is possible to use a commercially available resin for the cellulose ether type resin. For example, in the case of ethyl cellulose, possible resins include: "Ethocel (registered trademark) STD4", "Ethocel (registered trademark) STD7" or "Ethocel (registered trademark) STD10", made by Dow Chemical Co., or the like. These resins may be used independently, or two or more types of the resins may be used in combination, depending on the circumstances.

The content of the cellulose ether type resin is preferably 1 to 6 parts by mass, more preferably, 2 to 5 parts by mass, and even more preferably, 3 to 4 parts by mass, per 100 parts by mass of the liquid developer. If the content of the cellulose ether type resin is too small, then the amount of coating of cellulose ether type resin which collects on the surface of the recording medium becomes too small, and there is possibility that the coating forming properties, and hence the fixing properties, will be insufficient. If the content of the cellulose ether type resin is too large, then the amount of coating of the cellulose ether type resin collecting on the surface of the recording medium will be too large, and hence there is a possibility of excessive decline in the drying properties of the coating, excessive increase in the adhesiveness (tackiness) of the coating, and excessive decline in the wear resistance of the image. Furthermore, there is a possibility that developing properties will become insufficient, the image density will become poor, and fogging will increase.

A second example of the liquid developer, for instance, is a liquid developer containing carrier liquid, coloring particles dispersed in the carrier liquid, and resin dissolved in the carrier liquid, in which the resin contains a cyclic olefin copolymer.

The cyclic olefin copolymer is preferably a copolymer of norbornene and ethylene. The content of the cyclic olefin copolymer is preferably 2 to 8 parts by mass per 100 parts by mass of the liquid developer.

The carrier liquid is similar to the carrier liquid of the first example of the liquid developer.

Thereupon, the carrier liquid which can be used here is preferably a liquid which is capable of dissolving cyclic olefin copolymer (a liquid in which the solubility of cyclic olefin copolymer is relatively high), in addition to the properties described above. Moreover, there are no particular restrictions on the carrier liquid, provided that the cyclic olefin copolymer is dissolved in the carrier liquid. The carrier liquid may employ only a liquid in which the solubility of cyclic olefin copolymer is relatively high (a good solvent for cyclic olefin copolymer), or a mixture of a good solvent for cyclic olefin copolymer and a liquid in which the solubility of cyclic olefin copolymer is relatively low (a poor solvent for cyclic olefin copolymer). In this case, care is taken in such a manner that the conductivity of the whole carrier liquid and hence the conductivity of the liquid developer does not become too high, depending on the type of the carrier liquid used.

The coloring particles may be, for instance, similar to the coloring particles of the first example of the liquid developer.

Furthermore, similarly to the first example of a liquid developer described above, a liquid developer of this kind may include a dispersion stabilizer for promoting and stabilizing the dispersion of particles in the liquid developer. The dispersion stabilizer may be, for instance, similar to the dispersion stabilizer of the first example of the liquid developer.

The cyclic olefin copolymer is a non-crystalline thermoplastic olefin resin which has a cyclic olefin backbone as a main chain and does not include environmentally harmful substances. The cyclic olefin copolymer described above has excellent transparency, lightweight properties, and low water absorbency, and so on. Preferably, the cyclic olefin copolymer is a polymer compound having a main chain consisting of carbon-carbon bonds, and a cyclic hydrocarbon structure in at least a portion of the main chain. This cyclic hydrocarbon structure is introduced by using, as a monomer, a compound (cyclic olefin) having at least one olefin double bond in the cyclic hydrocarbon structure, such as norbornene or tetracyclododecene.

The cyclic olefin copolymer preferably has the following properties. Firstly, it is preferable that the cyclic olefin copolymer can exist stably for a long period of time in a dissolved state in the carrier liquid. Moreover, it is preferable, if the concentration of the cyclic olefin copolymer in the carrier liquid becomes high on the surface of the recording medium after the transfer of the image to the recording medium, and exceeds a saturation solubility amount, then the cyclic olefin copolymer is able to collect on the surface of the recording medium and form a coating. Possible examples of a cyclic olefin copolymer of this kind are, for instance: (1) an addition (co-)polymer of a cyclic olefin or a hydrogenated form thereof; (2) an addition copolymer of a cyclic olefin and an α-olefin or a hydrogenated form thereof; (3) an open-ring (co-)polymer of a cyclic olefin, or a hydrogenated form thereof, or the like.

Specific examples of the cyclic olefin are: (a) cyclopentene, cyclohexene, cyclooctene; (b) cyclopentadiene, 1,3-cyclohexadiene, or other single-ring cyclic olefins; (c) double-ring cyclic olefins, such as bicyclo [2.2.1]hepta-2-ene (norbornene), 5-methyl-bicyclo [2.2.1]hepta-2-ene, 5,5-dimethyl-bicyclo [2.2.1]hepta-2-ene, 5-ethyl-bicyclo [2.2.1] hepta-2-ene, 5-butyl-bicyclo [2.2.1]hepta-2-ene, 5-ethyldene-bicyclo [2.2.1]hepta-2-ene, 5-hexyl-bicyclo [2.2.1] hepta-2-ene, 5-octyl-bicyclo [2.2.1]hepta-2-ene, 5-octadecyl-bicyclo [2.2.1]hepta-2-ene, 5-methylidene-bicyclo [2.2.1]hepta-2-ene, 5-vinyl-bicyclo [2.2.1]hepta-2-ene, 5-propenyl-bicyclo [2.2.1]hepta-2-ene, or the like; (d) tricyclo [4.3.0.12,5]deca-3,7-diene (dicyclopentadiene), tricyclo [4.3.0.12,5]deca-3-ene; (e) tricyclo [4.4.0.12,5]undeca-3,7-diene, or tricyclo [4.4.0.12,5]undeca-3,8-diene, or tricyclo [4.4.0.12,5]undeca-3-ene, which is a partial hydrogenated form of these (or an adduct of cyclopentadiene and cyclohexene); (f) triple-ring cyclic olefins, such as 5-cyclopentyl-bicyclo [2.2.1]hepta-2-ene, 5-cyclohexyl-bicyclo [2.2.1]hepta-2-ene, 5-cyclohexenyl-bicyclo [2.2.1]hepta-2-ene, 5-phenyl-bicyclo [2.2.1]hepta-2-ene, or the like; (g) quadruple-ring cyclic olefins, such as tetracyclo [4.4.0.12, 5.17,10]dodeca-3-ene (tetracyclododecane), 8-methyl tetracyclo [4.4.0.12, 5.17,10]dodeca-3-ene, 8-ethyl tetracyclo [4.4.0.12, 5.17,10] dodeca-3-ene, 8-methylidene tetracyclo [4.4.0.12, 5.17,10] dodeca-3-ene, 8-ethylidene tetracyclo [4.4.0.12, 5.17,10] dodeca-3-ene, 8-vinyl tetracyclo [4.4.0.12, 5.17,10]dodeca-3-ene, 8-propenyl-tetracyclo [4.4.0.12, 5.17,10]dodeca-3-ene or the like; (h) 8-cyclopentyl-tetracyclo [4.4.0.12, 5.17, 10]dodeca-3-ene, 8-cyclohexyl-tetracyclo [4.4.0.12, 5.17, 10]dodeca-3-ene, 8 cyclohexenyl-tetracyclo [4.4.0.12, 5.17, 10]dodeca-3-ene, or 8-phenyl-cyclopentyl-tetracyclo [4.4.0.12, 5.17,10]dodeca-3-ene; (i) tetracyclo [7.4.13, 6.01, 9.02,7]tetradeca-4,9,11,13-tetraene (1,4-methano-1,4,4a,9a-tetrahydrofluorene), or tetracyclo [8.4.14, 7.01,10.03,8]pentadeca-5,10,12,14-tetraene (1,4-methano-1,4,4a,5,10,10a-hexahydroanthracene); (j) pentacyclo [6.6.1.13, 6.02, 7.09, 14]-4-hexadecene, pentacyclo [6.5.1.13, 6.02, 7.09, 13]-4-pentadecene, pentacyclo [7.4.0.02, 7.13, 6.110, 13]-4-pentadecene, pentacyclo [8.7.0.12, 9.14, 7.111, 17.03, 8.01, 2,16]-5-eicosene, or pentacyclo [8.7.0.12, 9.03, 8.14, 7.012, 17.113, 16]-14-eicosene; or (k) multiple-ring cyclic olefins such as cyclopentadiene tetramer, or the like. These cyclic olefins can be used either independently, or as a combination of two or more types.

The α-olefin is preferably an α-olefin having 2 to 20 carbon atoms, and preferably 2 to 8 carbon atoms, specific examples being: ethylene, propylene, 1-butene, 1-pentene, 1-hexene, 3-methyl-1-butene, 3-methyl-1-pentene, 3-ethyl-1-pentene, 4-methyl-1-pentene, 4-methyl-1-hexene, 4,4-dimethyl-1-hexene, 4,4-dimethyl-1-pentene, 4-ethyl-1-hexene, 3-ethyl-1-hexene, 1-octene, 1-decene, 1-dodecene, 1-tetradecene, 1-hexadecene, 1-octadecene, 1-eicosene, and the like. These α-olefins can be used either independently, or as a combination of two or more types.

There are no particular restrictions on the polymerization method of the cyclic olefin, the polymerization method of the cyclic olefin and the α-olefin, and the hydrogenation method of the obtained polymer, and it is possible to implement commonly known methods.

Furthermore, there are no particular restrictions on the structure of the cyclic olefin copolymer, which may be a chain structure, a branched structure or a cross-linked structure, but preferably, is a straight chain structure.

For the cyclic olefin copolymer described above, it is desirable to use a copolymer of norbornene and ethylene, or a copolymer of tetracyclododecene and ethylene, and it is more desirable to use a copolymer of norbornene and ethylene. In this case, the content of norbornene in the copolymer is preferably 60 to 82 mass %, more preferably, 60 to 79 mass %, even more preferably, 60 to 76 mass %, and yet more preferably, 60 to 65 mass %. If the norbornene content is too low, then the glass transition temperature of the coating of cyclic olefin copolymer becomes too low and there is a possibility of decline in the coating forming properties of the cyclic olefin copolymer coating. Furthermore, if the norbornene content is too high, then the glass transition temperature of the coating of cyclic olefin copolymer becomes too high and there is a possibility of decline in the fixing properties of the pigment, and hence the image, by means of the cyclic olefin copolymer coating. Furthermore, there is a possibility that the solubility of the cyclic olefin copolymer in the carrier liquid will become excessively low.

It is possible to use a commercially available product for the cyclic olefin copolymer. For example, possible examples of the copolymer of norbornene and ethylene include the following products made by Topas Advanced Polymers GmbH: "TOPAS (registered trademark) ™" (norbornene content rate: approximately 60 mass %; glass transition temperature: approximately 60° C.), "TOPAS (registered trademark) ™" (norbornene content rate approximately 60 mass %; glass transition temperature: approximately 60° C.), "TOPAS (registered trademark) 8007"(norbornene content rate: approximately 65 mass %; glass transition temperature: approximately 80° C.), "TOPAS (registered trademark) 5013" (norbornene content rate: approximately 76 mass %; glass transition temperature: approximately 140° C.), "TOPAS (registered trademark) 6013" (norbornene content rate: approximately 76 mass %; glass transition temperature: approximately 140° C.), "TOPAS (registered trademark) 6015" (norbornene content rate approximately 79 mass %; glass transition temperature: approximately 160° C.), "TOPAS (registered trademark) 6017" (norbornene content rate approximately 82 mass %; glass transition temperature: approximately 180° C.), and the like. These copolymers may be used independently, or two or more types of the copolymers may be used in combination, depending on the circumstances.

The content of the cyclic olefin copolymer is preferably 2 to 8 parts by mass, more preferably, 3 to 6 parts by mass, and even more preferably, 3.5 to 4 parts by mass, per 100 parts by mass of the liquid developer. If the content of the cyclic olefin copolymer is too small, then the amount of coating of cyclic olefin copolymer which collects on the surface of the recording medium becomes too small, and there is a possibility that the coating forming properties, and hence the fixing properties, will be insufficient. Furthermore, if the content of the cyclic olefin copolymer is too large, then the amount of skin of the cyclic olefin copolymer collecting on the surface of the recording medium will be too large, and hence there is a possibility of excessive decline in the drying properties of the coating, excessive increase in the adhesiveness (tackiness) of the coating, and excessive decline in the wear resistance of the image.

Furthermore, for the carrier liquid included in the liquid developer, as described above, it is possible to use an independent liquid or to use a combination of liquids or two or more types.

If a combination of two or more types of liquid is used as the carrier liquid included in the liquid developer, then, for instance, the liquids include at least a first solvent in which the resin contained in the liquid developer is not soluble and a second solvent in which the resin is soluble. More specifically, this is a mixed solvent of a poor solvent and a good solvent with respect to the resin contained in the liquid developer. If the carrier liquid is a mixed solvent of a first solvent and a second solvent of this kind, then it is desirable to use the first solvent as the aggregation promoting agent. In so doing, it is possible to clean liquid developer remaining on the intermediate transfer belt 21 appropriately with the cleaning unit 22 of the intermediate transfer belt 21 after the secondary transfer, without using components other than the components which constitute the liquid developer.

Furthermore, when using a combination of two or more types of liquid is used as the carrier liquid, it is possible to compose the image forming apparatus relating to the present embodiment in such a manner that, as described below, liquid is supplied from a carrier tank storing carrier liquid for adjusting the liquid developer, not only in order to adjust the liquid developer, but also as an aggregation promoting agent.

Preferably, the resin contained in the liquid developer includes cellulose ether type resin, the carrier liquid contained in the liquid developer is a mixed solvent of a tall oil fatty acid and an aliphatic hydrocarbon, and the aggregation promoting agent included in the liquid developer is an aliphatic hydrocarbon. Moreover, preferably, the cellulose ether type resin is ethyl cellulose.

By using a liquid developer and an aggregation promoting agent of this kind, it is possible to clean the liquid developer remaining on the intermediate transfer belt 21 appropriately after secondary transfer, and moreover, it is possible to form an image by fixing a coloring particle image which has been transferred onto the recording medium, regardless of the type of energy used, such as light energy, thermal energy, or the like.

This is thought to be because of the following reasons.

By using an aliphatic hydrocarbon as the aggregation promoting agent, it is possible to achieve suitable compatibility with a tall oil fatty acid, and the cellulose ether type resin dissolved in the liquid developer can be caused to aggregate. Therefore, it is possible to recover the cellulose ether type resin which has been aggregated together with the coloring particles, suitably, by means of the cleaning unit.

Furthermore, if a liquid developer of this kind is used, then after the coloring particles have been transferred to the recording medium, the carrier liquid is absorbed inside the recording medium. During this absorption, the cellulose ether type resin collects on the surface of the recording medium, forming a coating, while covering the coloring particles, such as pigment, which have collected on the surface of the recording medium. The coloring particles are fixed on the recording medium by means of the coating of this cellulose ether type resin. Therefore, it is possible to form an image by fixing the coloring particle image which has been transferred to the recording medium, regardless of the type of energy used, such as light energy or thermal energy.

In view of the foregoing, it is possible to clean the liquid developer remaining on the intermediate transfer belt 21 appropriately after secondary transfer, and moreover, it is possible to form an image by fixing a coloring particle image which has been transferred onto the recording medium, regardless of the type of energy used, such as light energy, thermal energy, or the like.

Furthermore, in the cases described above, preferably, the content of the cellulose ether type resin is 1 to 6 parts by mass per 100 parts by mass of liquid developer, and the content of tall oil fatty acid is 20 to 90 parts by mass per 100 parts by mass of liquid developer. By adopting this composition, it is possible to appropriately display the aforementioned effects of the cellulose ether type resin or tall oil fatty acid, and more suitable cleaning is possible.

Furthermore, if the carrier liquid included in the liquid developer consists of a single liquid, then preferably, the resin contained in the liquid developer includes cyclic olefin copolymer, the carrier liquid contained in the liquid developer is an aliphatic hydrocarbon, and the aggregation promoting agent contained in the liquid developer is an alcohol solvent. Moreover, for the cyclic olefin copolymer, it is desirable to use a copolymer of norbornene and ethylene.

By using a liquid developer and an aggregation promoting agent of this kind, it is possible to clean liquid developer remaining on the intermediate transfer belt 21 appropriately after secondary transfer, and moreover, it is also possible to form an image by fixing a coloring particle image that has been transferred to the recording medium, regardless of the energy used, such as light energy, thermal energy, or the like.

This is thought to be because of the following reasons.

By using an alcohol solvent as the aggregation promoting agent, it is possible to aggregate the cyclic olefin polymer dissolved in the liquid developer. Therefore, it is possible to recover the cyclic olefin polymer which has been aggregated together with the coloring particles, suitably, by means of the cleaning unit.

Furthermore, if a liquid developer of this kind is used, then after the coloring particles have been transferred to the recording medium, the carrier liquid is absorbed inside the recording medium. During this absorption, the cyclic olefin polymer collects on the surface of the recording medium, forming a coating, while covering the coloring particles, such as pigment, which have collected on the surface of the recording medium. The coloring particles are fixed on the recording medium by means of the coating of this cellulose ether type resin. Therefore, it is possible to fix the coloring particle image which has been transferred to the recording medium, regardless of the type of energy used, such as light energy or thermal energy.

In view of the foregoing, it is possible to clean the liquid developer remaining on the intermediate transfer belt 21 appropriately after secondary transfer, and moreover, it is possible to fix a coloring particle image which has been transferred onto the recording medium, regardless of the type of energy used, such as light energy, thermal energy, or the like.

Furthermore, in cases such as that described above, the content of cyclic olefin polymer is preferably 2 to 8 parts by mass per 100 parts by mass of the liquid developer. By adopting this composition, it is possible to appropriately display the aforementioned effects of the cyclic olefin polymer, and more suitable cleaning is possible.

Moreover, there are no particular restrictions on the rate of supply of the aggregation promoting agent from the supply nozzle 104, provided that suitable cleaning can be performed by the cleaning unit 22 of the intermediate transfer belt 21. Although the supply rate varies depending on the type of aggregation promoting agent and resin, and other factors, it is preferably 0.15 to 0.5 g/sec., for instance. If the supply rate of the aggregation promoting agent is too slow, then the beneficial effects of raising cleaning properties by applying the aggregation promoting agent tend to become inadequate. Furthermore, if the supply rate of the aggregation promoting agent is too fast, then the beneficial effects of raising the cleaning properties tend to become saturated, and furthermore, the amount of liquid recovered by the cleaning unit 22 of the intermediate transfer belt 21 increases. More specifically, the result is that the amount of waste liquid simply increases, without considerably raising the effect of improving the cleaning properties.

Figure 4:
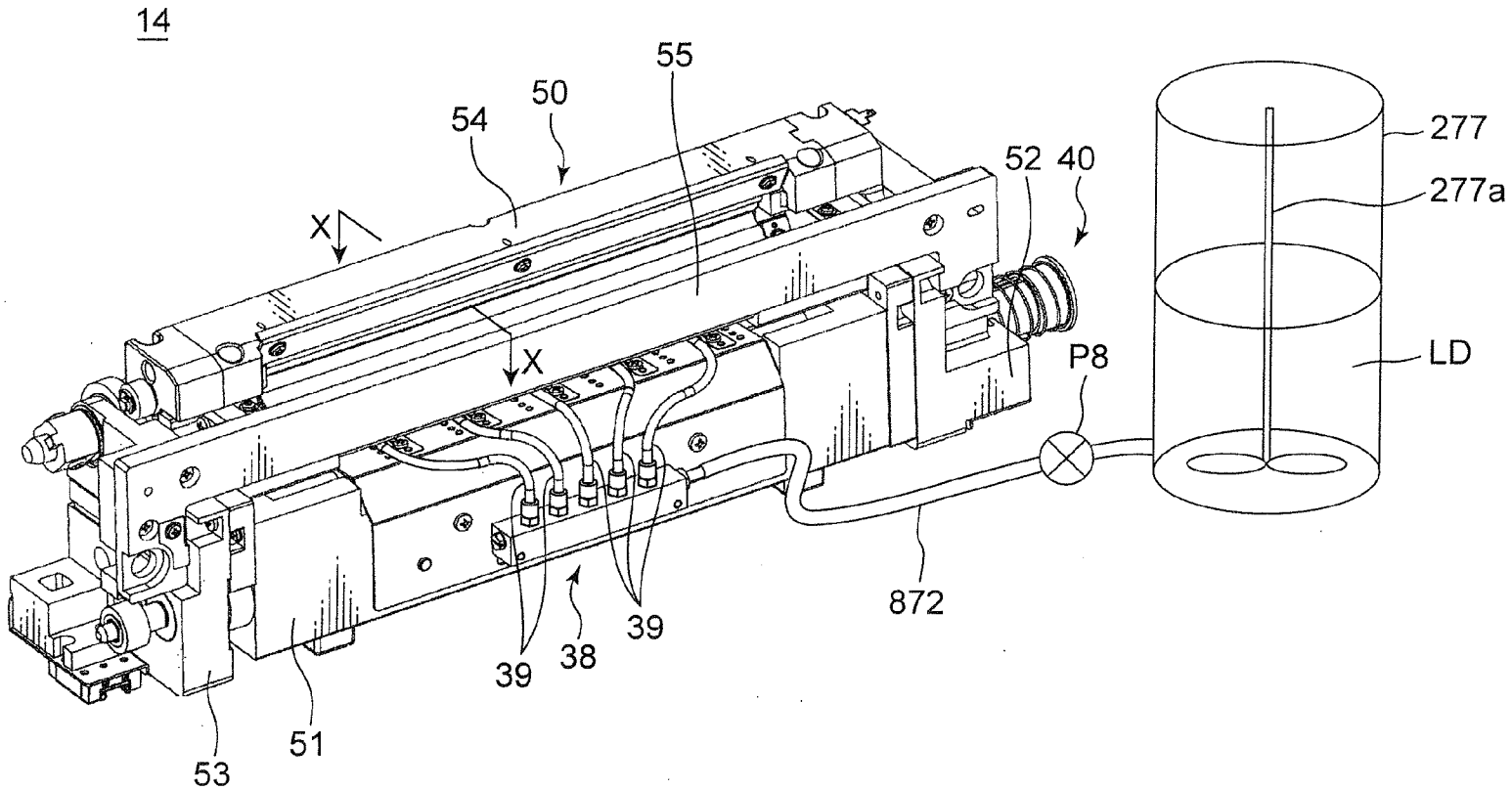
FIG. 4 is a perspective drawing of a developing apparatus provided in the image forming apparatus relating to the present embodiment, as viewed from one side, and depicts the overall structure of the developing apparatus in the lengthwise direction.
Figure 5:
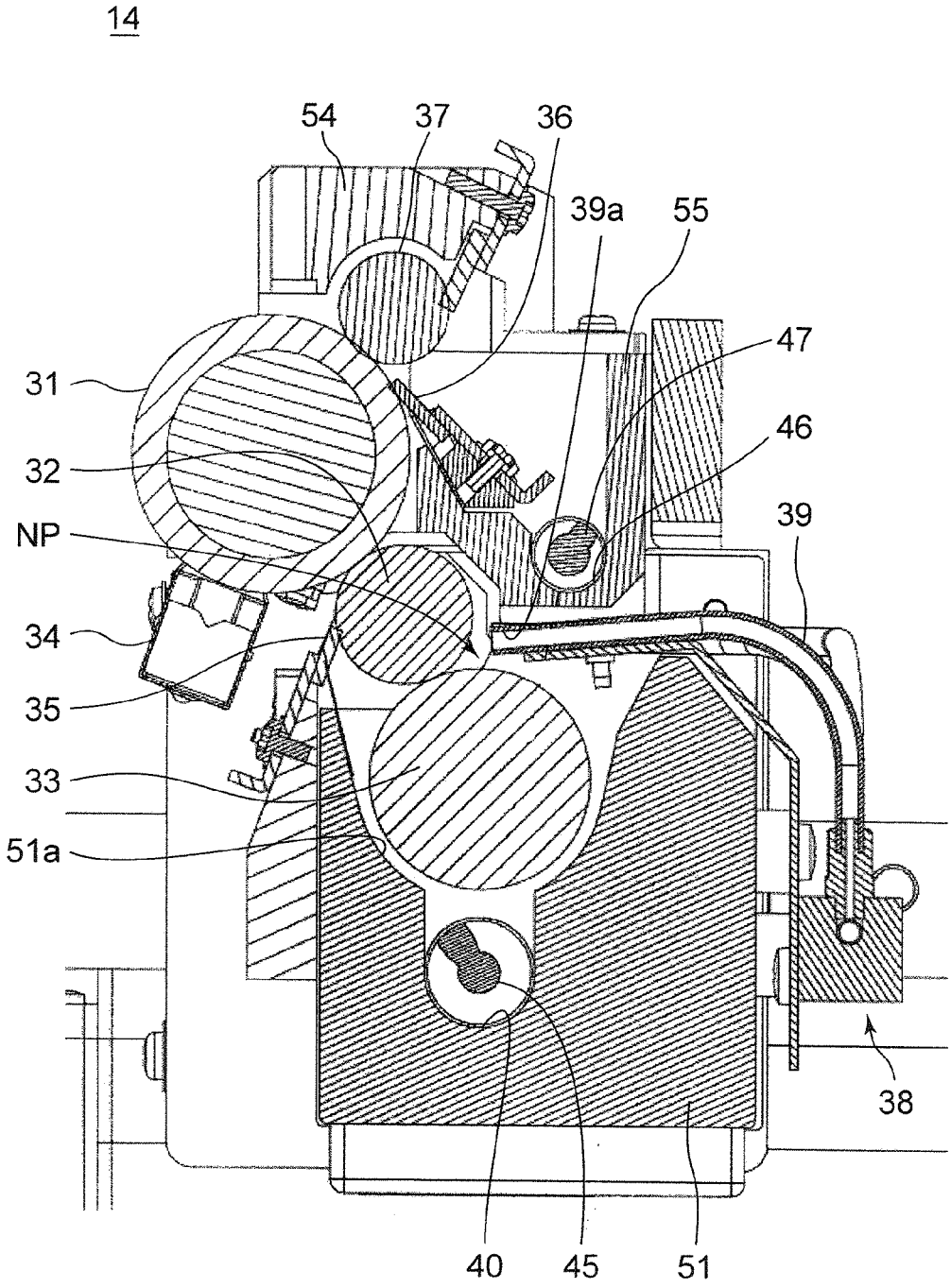
FIG. 5 is an approximate cross-sectional diagram along line X-X in FIG. 4.

Next, a developing apparatus 14 will be described with reference to FIG. 4 and FIG. 5. FIG. 4 is a perspective diagram showing a side view of a developing apparatus which is provided in the image forming apparatus shown in FIG. 1 and FIG. 2, and depicts the overall structure of the developing apparatus in the lengthwise direction. FIG. 5 is a cross-sectional diagram along line X-X in FIG. 4.

The developing apparatus 14 includes a development vessel 50 which accommodates the constituent elements described below. Moreover, the development vessel 50 is a member having a shape which extends in the lengthwise direction of the developing apparatus 14, in other words, the rotational axis direction of the photosensitive drum 10.

The developing apparatus 14 includes: a main body frame 51, an intermediate frame 55, an upper frame 54 and a pair of side frames 52, 53.

The main body frame 51 is a container-shaped member which extends in the lengthwise direction of the developing apparatus 14. Furthermore, the main body frame 51 is open to the upper side, as shown in FIG. 5. Two-step groove sections 51*a*, 40 extending in the lengthwise direction of the developing apparatus 14 are formed inside the main body frame 51. A nip forming roller 33, which is described below, is disposed rotatably in the upper side groove section 51*a*. A first conveyance screw 45 is disposed rotatably in the lower side groove section 40. The upper side groove section 51*a* and the lower side groove section 40 are connected to each other.

The intermediate frame 55 is a container-shaped member which extends in the lengthwise direction of the developing apparatus 14. Furthermore, the intermediate frame 55 is open on the upper side, and is also installed on the main body frame 51 from above so as to cover a portion of the opening of the main body frame 51. A groove section 46 extending in the lengthwise direction of the developing apparatus 14 is formed in the bottom portion of the intermediate frame 55. A second conveyance screw 47 is disposed rotatably in the groove section 46.

The upper frame 54 is a member which extends in the lengthwise direction of the developing apparatus 14. Furthermore, the upper frame 54 is installed from above on the intermediate frame 55, so as to cover the opening of the intermediate frame 55.

The main body frame 51, the intermediate frame 55 and the upper frame 54 each have substantially the same dimension in the lengthwise direction.

A pair of side face frames 52, 53 cover either side face of the main body frame 51, and either side face of the intermediate frame 55, in the respective end portions of the development vessel 50 in the lengthwise direction. A first recovery channel 40 which is described below projects outward in the lengthwise direction of the developing apparatus 14, from one side face frame 52.

As shown in FIG. 4 and FIG. 5, a liquid developer supply apparatus 38 for supplying liquid developer to the developing apparatus 14 is installed by screws, or the like, on the outer surface of the main body frame 51. The liquid developer supply apparatus 38 has a plurality of branch supply channels 39 (in the case of the developing apparatus shown in FIG. 4 and FIG. 5, five branch supply channels 39), which extend inside the developing apparatus 14.

The liquid developer supply apparatus 38 is connected to a liquid developer reserve tank (accommodation vessel) 277, via a supply tube 872. The liquid developer supply apparatus 38 supplies liquid developer LD to the developing apparatus 14 from the liquid developer reserve tank 277 which accommodates liquid developer LD. A churning member 277*a* is provided in the liquid developer reserve tank 277, and the liquid developer LD is churned appropriately by the churning member 277*a*.

As shown in FIG. 5, the developing apparatus 14 includes a developing roller 31, a supply roller 32, a nip forming roller 33, a restricting blade 35, a developing roller charging device 34, a cleaning roller 37 and a cleaning blade 36, these elements being provided inside the development vessel 50.

The nip forming roller 33 is a roller which is disposed rotatably inside the upper side groove section 51*a* of the main body frame 51, as described above. The supply roller 32 is a roller which extends in the rotation axis direction of the nip forming roller 33, in a position obliquely above the nip forming roller 33. The nip forming roller 33 is disposed so as to abut against the supply roller 32. By this means, a supply nip section NP is formed between the nip forming roller 33 and the supply roller 32. The plurality of branch supply channels 39 in the liquid developer supply apparatus 38 described above are arranged in line with the rotation axis direction of the nip forming roller 33. Ejection ports 39*a* of the branch supply channels 39 are directed towards the supply nip section NP. Consequently, liquid developer is ejected into the supply nip section NP by the liquid developer supply apparatus 38. In FIG. 5, the nip forming roller 33 is rotated in the counter-clockwise direction and the supply roller 32 is rotated in the clockwise direction.

The liquid developer ejected into the supply nip section NP from the ejection ports 39*a* collects temporarily in the supply nip section NP, and then passes through the supply nip section NP due to the rotation of the nip forming roller 33 and the supply roller 32, and is conveyed upwards while being held on the circumferential surface of the supply roller 32. Grooves for holding the liquid developer are formed on the circumferential surface of the supply roller 32.

The front end of the restricting blade 35 is pressed against the circumferential surface of the supply roller 32. By means of this pressed state, the restricting blade 35 restricts the amount of the liquid developer on the circumferential surface of the supply roller 32 to a prescribed amount. Furthermore, the restricting blade 35 is made from a material, such as urethane rubber, or the like, for instance. The excess liquid developer which is scraped away by the restricting blade 35 falls down under its own weight and accordingly is received in the upper side groove section 51*a* and then received in the lower side groove section 40. The lower side groove section (recovery channel) 40 constitutes a first recovery channel which recovers liquid developer that has been scraped away by the restricting blade 35, and the liquid developer is conveyed to a liquid developer recovery vessel 70 (FIG. 6) due to the rotation of the first conveyance screw 45.

The developing roller 31 is disposed so as to make contact with the supply roller 32, in an open section formed between the main body frame 51, the intermediate frame 55 and the upper frame 54. The developing roller 31 extends in parallel with the nip forming roller 33 and the supply roller 32, and rotates in the clockwise direction in FIG. 5. Consequently, the circumferential surface of the developing roller 31 moves in the opposite direction to the circumferential surface of the supply roller 32 in the nip section where the developing roller 31 and the supply roller 32 make contact with each other. Consequently, the liquid developer held on the circumferential surface of the supply roller 32 is received on the circumferential surface of the developing roller 31. Since the thickness of the layer of liquid developer on the supply roller 32 is restricted to a prescribed value, then the thickness of the liquid developer layer formed on the circumferential surface of the developing roller 31 is kept to a prescribed value.

The developing roller charging device 34 performs an action of increasing the developing efficiency by moving the coloring particles in the liquid developer layer held on the developing roller 31, to the circumferential surface side of the developing roller 31, by applying a charging potential of the same polarity as the charging polarity of the coloring particles. The developing roller charging device 34 is provided so as to oppose the circumferential surface of the developing roller 31, to the downstream side of the nip section between the developing roller 31 and the supply roller 32, and the upstream side of the nip section between the developing roller 31 and the photosensitive drum 10, as viewed in the direction of rotation of the developing roller 31.

The developing roller 31 lies in close proximity to the photosensitive drum 10 and forms a nip section with the photosensitive drum 10. The electrostatic latent image on the circumferential surface of the photosensitive drum 10 is developed by moving coloring particles onto the circumferential surface of the photosensitive drum 10 by means of the potential difference between the potential of the electrostatic latent image and the developing bias which is applied to the developing roller 31. By this means, a coloring particle image is formed on the circumferential surface of the photosensitive drum 10.

The cleaning roller 37 is arranged to the downstream side of the photosensitive drum 10 as viewed in the direction of rotation of the developing roller 31, and the circumferential surface thereof contacts the circumferential surface of the developing roller 31. By this means, the liquid developer remaining on the circumferential surface of the developing roller 31 is scraped away. The liquid developer which has been scraped away is received in the groove section 46 formed in the intermediate frame 55.

Figure 6:
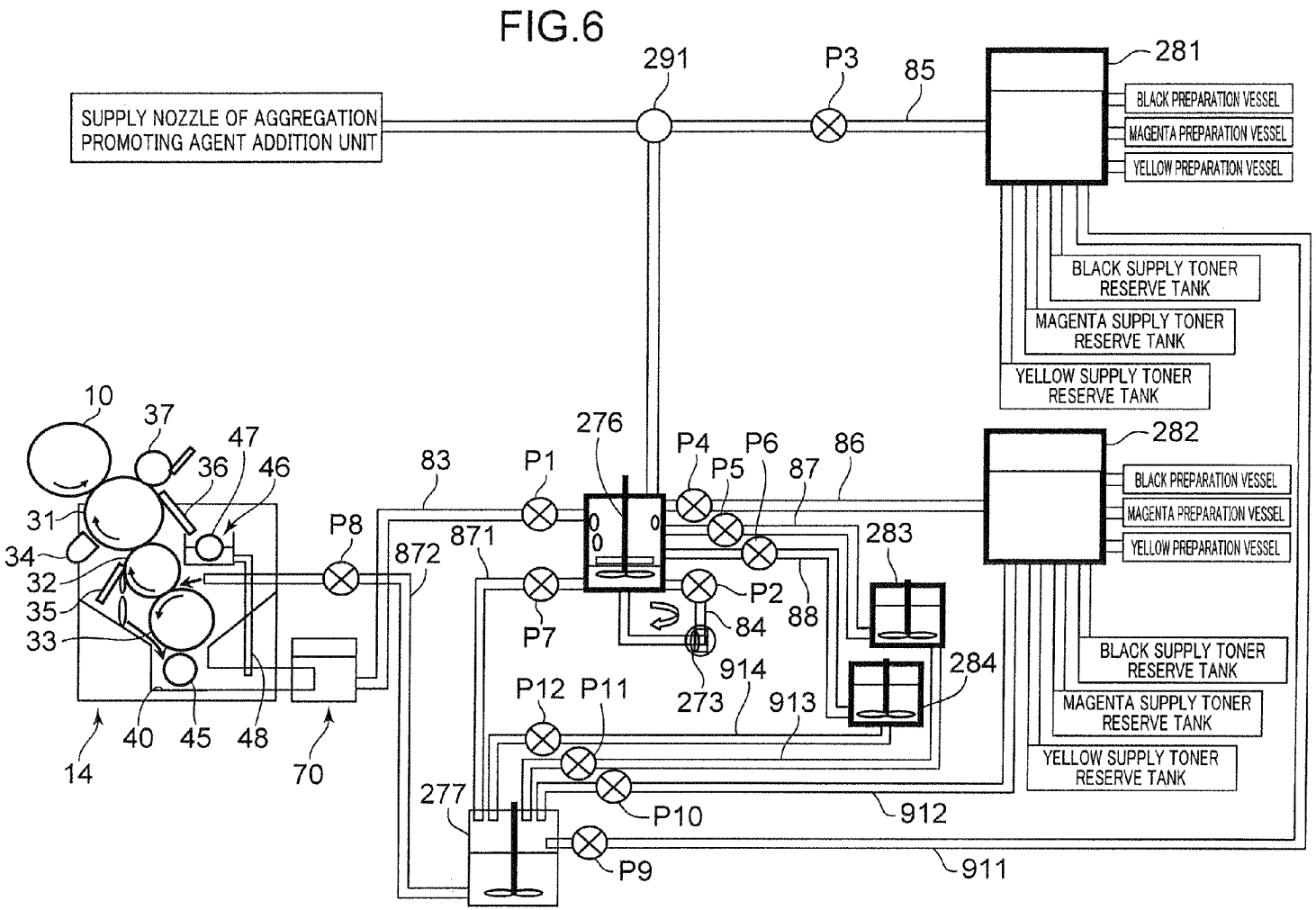
FIG. 6 is a drawing for describing a circulation system in a liquid developer circulation apparatus provided in the image forming apparatus relating to the present embodiment.

The cleaning blade 36 is arranged to the downstream side of the cleaning roller 37 as viewed in the direction of rotation of the developing roller 31, and the front tip thereof contacts the circumferential surface of the developing roller 31. By this means, the liquid developer remaining on the circumferential surface of the developing roller 31 which has not been removed by the cleaning roller 37 is further scraped away by the cleaning blade 36. The liquid developer which has been scraped away flows down over the surface of the cleaning blade 36 and is received in the groove section 46 formed in the intermediate frame 55. The groove section 46 is constituted as a second recovery channel. The liquid developer in the second recovery channel (groove section) 46 is guided to a confluence channel 48 which connects the second recovery channel 46 and the first recovery channel 40, by the rotation of the second conveyance screw 47 (FIG. 6). Thereupon, the liquid developer which has been guided to the confluence channel 48 is conveyed along the first recovery channel 40 to the liquid developer recovery vessel 70.

Next, the liquid developer circulation system which supplies liquid developer to the developing apparatus 14 and recovers and reuses the liquid developer from the developing apparatus 14 will be described with reference to FIG. 6. FIG. 6 is a general view of the composition of one liquid developer circulation apparatus LC, and shows a schematic view of the liquid developer circulation system. The other liquid developer circulation apparatuses LY, LM, LB have the same composition. The liquid developer circulation apparatus LC serves to supply the liquid developer to the developing apparatus 14, as well as reusing liquid developer which has been recovered into the liquid developer recovery vessel 70 via the first recovery channel 40 and the second recovery channel 46.

Furthermore, a case is described here where liquids of two types are used as the carrier liquid in the liquid developer. More specifically, a case is described where the liquid developer circulation apparatus prepares a liquid developer by mixing together a resin solution in which the resin contained in the liquid developer is dissolved in the carrier liquid, a pigment dispersion liquid in which a pigment constituting the coloring particles contained in the liquid developer is dispersed in the carrier liquid, and carrier liquids of two types. Therefore, the liquid developer circulation apparatus is composed in such a manner that one of the carrier liquids can be used as an aggregation promoting agent. More specifically, the liquid developer circulation apparatus is composed in such a manner that one of the carrier liquids can be supplied from the supply nozzle 104 of the aggregation promoting agent addition unit 101 to the application roller 102.

The liquid developer circulation apparatus LC includes: a liquid developer recovery vessel 70, a developer preparation vessel 272, a first carrier tank 281, a second carrier tank 282, a resin solution tank 283, a pigment dispersion liquid tank 284, a developer reserve tank 277 and a plurality of pumps P1 to P12.

The liquid developer recovery vessel 70 is connected to the developer preparation vessel 272 via a first pipe 83. A first pump P1 is provided in the first pipe 83, and liquid developer recovered into the liquid developer recovery vessel 70 is sent to the developer adjustment vessel 272 by the driving of the first pump P1.

The developer preparation vessel 272 adjusts the pigment concentration to a suitable range, by adding the first carrier liquid, the second carrier liquid, the resin solution and the pigment dispersion liquid, to the recovered liquid developer. The liquid developer having an adjusted pigment density is supplied again to the developing apparatus 14.

The solid concentration determination apparatus 273 is an apparatus for determining the pigment concentration of the liquid developer in the developer preparation vessel 272. The solid concentration determination apparatus 273 is connected to a ring-shaped second pipe 84 which is connected to the developer preparation vessel 272. Furthermore, the second pump P2 is installed in the second pipe 84. The liquid developer in the developer preparation vessel 272 is sent to the solid concentration determination apparatus 273 from the input end of the second pipe 84 by the driving of the second pump P2, and is then returned from the output end of the second pipe 84 to the developer preparation vessel 272.

The first carrier tank 281 is a tank which stores the first carrier liquid. The second carrier tank 282 is a tank which stores the second carrier liquid. If the solid concentration determination apparatus 273 judges that the pigment concentration in the developer preparation vessel 272 is higher than the suitable range, the first carrier liquid and the second carrier liquid are supplied in a prescribed ratio from the first carrier tank 281 and the second carrier tank 282 to the interior of the developer preparation vessel 272, and the pigment concentration of the liquid developer in the developer preparation vessel 272 becomes lower.

The first carrier tank 281 is connected to the developer preparation vessel 272 and a third pipe 85, and a third pump P3 is provided in the third pipe 85. Furthermore, the third pipe 85 includes a flow channel changing unit 291 and is connected to the supply nozzles 104 of the aggregation promoting agent addition unit 101 via this flow channel changing unit 291. By driving the third pump P3 and switching the flow channel changing unit 291, in addition to supplying the first carrier liquid to the developer preparation vessel 272 from the first carrier tank 281, the carrier liquid is also supplied to the supply nozzles 104 of the aggregation promoting agent addition unit 101. Consequently, it is possible to use the first carrier liquid as an aggregation promoting agent, as well.

Furthermore, the second carrier tank 282 is connected to the developer preparation vessel 272 and a fourth pipe 86, and a fourth pump P4 is provided in the fourth pipe 86. The second carrier liquid is supplied to the developer preparation vessel 272 from the second carrier tank 282 by the driving of the fourth pump P4.

The resin solution tank 283 is a tank which stores a resin solution. If the solid concentration determination apparatus 273 judges that the resin concentration in the developer preparation vessel 272 is lower than the suitable range, then resin solution is supplied from the resin solution tank 283 to the developer preparation vessel 272 and the resin concentration of the liquid developer in the vessel 272 becomes greater. The resin solution tank 283 is connected to the developer preparation vessel 272 and a fifth pipe 87, and a fifth pump P5 is provided in the fifth pipe 87. Resin solution is supplied from the resin solution tank 283 to the developer preparation vessel 272 by the driving of the fifth pump P5.

The pigment dispersion liquid tank 284 is a tank which stores a pigment dispersion. If the solid concentration determination apparatus 273 judges that the pigment concentration in the developer preparation vessel 272 is lower than the suitable range, then pigment dispersion liquid is supplied from the pigment dispersion liquid tank 284 to the developer preparation vessel 272 and the pigment concentration of the liquid developer in the vessel 272 becomes greater. The pigment dispersion liquid solution tank 284 is connected to the developer preparation vessel 272 and a sixth pipe 88, and a sixth pump P6 is provided in the sixth pipe 88. Pigment dispersion liquid is supplied from the pigment dispersion liquid tank 284 to the developer preparation vessel 272 by the driving of the sixth pump P6.

A churning apparatus 276 for churning the liquid developer is provided inside the developer preparation vessel 272. By churning by means of the churning apparatus 276, the first carrier liquid, the second carrier liquid, the resin solution and the pigment dispersion liquid which have been introduced into the developer preparation vessel 272 can be combined uniformly with the existing liquid developer in the developer preparation vessel 272. Furthermore, by churning by means of the churning apparatus 276, it is possible to re-distribute the pigment which may be aggregated in the liquid developer accommodated inside the developer preparation vessel 272.

The churning apparatus 276 includes a rotational shaft and a churning blade which is installed on the front end of this rotational shaft.

The developer reserve tank 277 is a tank which accommodates liquid developer for replenishment to the developing apparatus 14 via the liquid developer supply apparatus 38 (FIG. 4). The developer reserve tank 277 is connected to the developer preparation vessel 272 and a seventh pipe 871, and a seventh pump P7 is provided in the seventh pipe 871. Liquid developer is supplied from the developer preparation vessel 272 to the developer reserve tank 277 by the driving of the seventh pump P7.

Furthermore, the developer reserve tank 277 is connected to the liquid developer supply apparatus 38 (FIG. 4) by the supply tube 872. As stated previously, an eighth pump P8 is provided in the supply tube 872, and liquid developer is supplied from the developer reserve tank 277 to the liquid developer supply apparatus 38 by driving the eighth pump P8.

Moreover, the developer reserve tank 277 is connected to the first carrier tank 281 via a first direct linking pipe 911. Furthermore, the developer reserve tank 277 is connected to the second carrier tank 282 via a second direct linking pipe 912. Moreover, the developer reserve tank 277 is connected to the resin solution tank 283 via a third direct linking pipe 913. Furthermore, the developer reserve tank 277 is connected to the pigment dispersion liquid tank 284 via a fourth direct linking pipe 914. A ninth pump P9, a tenth pump P10, an eleventh pump P11 and a twelfth pump P12 are respectively provided in the first direct linking pipe 911, the second direct linking pipe 912, the third direct linking pipe 913 and the fourth direct linking pipe 914. More specifically, the first carrier liquid, the second carrier liquid, the resin solution and the pigment dispersion liquid are supplied directly to the developer reserve tank 277, from the first carrier tank 281, the second carrier tank 282, the resin solution tank 283 and the pigment dispersion liquid tank 284. The supply system for the first carrier liquid, the second carrier liquid, the resin solution and the pigment dispersion liquid, from the first direct linking pipe 911, the second direct linking pipe 912, the third direct linking pipe 913 and the fourth direct linking pipe 914, is used in cases where liquid developer is to be generated rapidly in accordance with a known mixture ratio, for instance, when starting to use a color printer 1 in which recovered liquid developer has not yet occurred.

Although not shown in the drawings, a liquid surface detection apparatus for detecting the height of the liquid surface in the tanks is provided at a suitable position in the liquid developer recovery vessel 70, the first carrier tank 281, the second carrier tank 282, the resin solution tank 283, the pigment dispersion liquid tank 284 and the developer reserve tank 277.

The first carrier tank 281 and the second carrier tank 282 are connected to the developer preparation vessels of the respective colors of black, magenta and yellow, and are also connected to the developer reserve tanks of the respective colors of black, magenta and yellow.

The image forming apparatus relating to the present embodiment can form a high-quality image on a recording medium using liquid developer by means of the operation described above.

EXAMPLES

Below, the present disclosure is described more specifically by means of practical examples. The present disclosure is, however, not limited in any way to the examples.

(Preparation of Liquid Developer A)

20 parts by mass of cyan pigment (C.I. Pigment Blue 15:3), as coloring particles, and 8 parts by mass of Solsperse 17000 made by Lubrizol Corp., as a dispersion stabilizer, were mixed with 72 parts by mass of a fluid paraffin (Moresco White P-200) made by Moresco Corp., as a first carrier liquid. This mixture was crushed in a dyno-mill (made by Shinmaru Enterprises Corporation) to obtain a pigment dispersion. The pigment dispersion had a volume-average particle size of 0.5 μm of the pigment contained therein.

Furthermore, a resin solution was prepared by dissolving 5 parts by mass of ethyl cellulose as a cellulose ether type resin (Ethocel STD4) in 95 parts by mass of tall oil fatty acid (Hartall FA-1 made by Harima Chemicals, Inc.) as a second carrier liquid.

A cyan liquid developer A having a pigment concentration of 5 mass % and a resin concentration of 3.8 mass % was prepared by mixing the resin solution and the pigment dispersion in a combination ratio (mass ratio) of 3:1.

The ethyl cellulose, which was the resin, was not soluble in the fluid paraffin, which was the first carrier liquid. The ethyl cellulose resin was soluble in the tall oil fatty acid, which was the second carrier liquid.

(Preparation of Liquid Developer B)

A resin solution was prepared by dissolving 5 parts by mass of a copolymer of norbornene and ethylene, "TOPAS (registered trademark) ™" (norbornene content: approximately 60 mass %, glass transition temperature: approximately 60° C.) made by Topas Advanced Polymers GmbH, as a cyclic olefin polymer, in 95 parts by mass of fluid paraffin ("Moresco White P-200" made by Moresco Corp.), as a carrier liquid.

Furthermore, a pigment dispersion was prepared by mixing and dispersing 20 parts by mass of cyan pigment (C.I. Pigment Blue 15:3) as coloring particles, and 8 parts by mass of ISP "Antaron (registered trademark) V-216" as a dispersion stabilizer, in 72 parts by mass of fluid paraffin as a carrier liquid ("Moresco White P-200" made by Moresco Corp.) for 1 hour at a drive frequency of 60 Hz, using a rocking mill (RM-10 made by Seiwa Giken Co., Ltd.)

The average particle size (D50) of the pigment in the pigment dispersion was 0.5 μm. A cyan liquid developer B having a pigment content of 5 mass %, and a cyclic olefin copolymer content of 3.75 mass %, as shown in Table 1, was prepared by mixing the resin solution and the pigment dispersion in a combination ratio (mass ratio) of 3:1.

The copolymer of norbornene and ethylene, which formed the resin, was soluble in the fluid paraffin, which formed the carrier liquid.

Example 1

A prescribed image pattern was printed on blank A4 paper (a recording medium), under the following conditions, using the liquid developer A and an image forming apparatus (color printer) shown in FIGS. 1 to 6 (an actual wet-type image forming apparatus made by Kyocera Mita K.K., which is equipped with a polyimide intermediate transfer belt). The printing conditions in this case were as follows: linear speed 0.1 m/s, developing bias of 300 V applied to the developing roller, surface potential of photosensitive drum 450 V, developing bias (intermediate transfer bias) applied to transfer roller of secondary transfer unit 300 V, current (transfer current) flowing in the intermediate transfer belt during secondary transfer 30 μA.

Exxon Mobil Isopar G was supplied at a supply rate of 0.2 g/s, as an aggregation promoting agent, from the supply nozzles 104 of the aggregation promoting agent addition unit 101.

The resin contained in the liquid developer A was insoluble in Isopar G which was used as the aggregation promoting agent.

Furthermore, the Isopar G which was used as the aggregation promoting agent was compatible with the carrier liquid contained in the liquid developer A. More specifically, the Isopar G used as the aggregation promoting agent was mutually dissolvable with the carrier liquid contained in the liquid developer A.

Example 2

The same test as Example 1 was performed in Example 2, except that fluid paraffin (Moresco White P-200 made by Moresco Corp.) was used as the first carrier liquid contained in the liquid developer A, instead of Isopar G.

The resin contained in the liquid developer A was insoluble in the Moresco White P-200 which was used as the aggregation promoting agent.

Furthermore, the Moresco White P-200 which was used as the aggregation promoting agent was compatible with the carrier liquid contained in the liquid developer A. More specifically, the Moresco White P-200 used as the aggregation promoting agent was mutually dissolvable with the carrier liquid contained in the liquid developer A.

Example 3

The same test as Example 1 was performed in Example 3, except that the liquid developer B was used instead of the liquid developer A and isopropanol was used instead of Isopar G as an aggregation promoting agent.

The resin contained in the liquid developer B was insoluble in isopropanol which was used as the aggregation promoting agent.

Furthermore, the isopropanol used as the aggregation promoting agent was not readily compatible with the carrier liquid contained in the liquid developer B.

Comparative Example 1

The same test as Example 1 was performed in Comparative Example 1, except that tall oil fatty acid (Hartall FA-1 made by Harima Chemicals Inc.) was used as the second carrier liquid contained in the liquid developer A, instead of Isopar G.

The resin contained in the liquid developer A was soluble in the Hartall FA-1 used as the aggregation promoting agent.

Furthermore, the Hartall FA-1 used as the aggregation promoting agent was compatible with the carrier liquid contained in the liquid developer A. More specifically, the Hartall FA-1 used as the aggregation promoting agent was mutually dissolvable with the carrier liquid contained in the liquid developer A.

Comparative Example 2

The same test as Example 3 was performed in Comparative Example 2, with the exception that fluid paraffin (Moresco White P-200 made by Moresco Corp.) was used instead of isopropanol.

The resin contained in the liquid developer B was soluble in the Moresco White P-200 used as the aggregation promoting agent.

Furthermore, the Moresco White P-200 used as the aggregation promoting agent was the same as the carrier liquid contained in the liquid developer B.

Comparative Example 3

The same test as Example 1 was performed in Comparative Example 3, with the exception that no liquid was supplied from the supply nozzles 104 of the aggregation promoting agent addition unit 101.

(Evaluation)

Examples 1 to 3 and Comparative Examples 1 to 3 described above were evaluated as indicated below.

100 prints of a prescribed image pattern were made under the various conditions described above, whereupon the intermediate transfer belt was checked visually after passing the cleaning unit of the intermediate transfer belt (the intermediate transfer belt after cleaning). Moreover, an image (formed image) which was formed on the recording medium after making 100 prints was checked visually.

As a result of this, if virtually no residual liquid developer was observed on the intermediate transfer belt after cleaning and no occurrence of problems such as fogging was observed in the formed image, then the evaluation verdict was "AA".

If a certain amount of residual liquid developer was observed on the intermediate transfer belt after cleaning and no occurrence of problems such as fogging was observed in the formed image, then the evaluation verdict was "A".

If a certain amount of residual liquid developer was observed on the intermediate transfer belt after cleaning and partial sticking of the coloring particles due to residual liquid developer was observed, then the evaluation verdict was "B".

If sticking of the coloring particles due to residual liquid developer was observed on the whole surface of the intermediate transfer belt, then the evaluation verdict was "C".

As a result of this, the evaluation for Example 1 was "AA", and the evaluation for Example 2 and Example 3 was "A". On the other hand, the evaluation for Comparative Example 1 and Comparative Example 2 was "B" and the evaluation for Comparative Example 3 was "C".

According to the results, it could be seen that cleaning of the intermediate transfer belt is carried out satisfactorily by the cleaning unit of the intermediate transfer belt, when an aggregation promoting agent which promotes aggregation of resin contained in the liquid developer is added to the intermediate transfer belt before passing through the cleaning unit of the intermediate transfer belt after secondary transfer (Examples 1 to 3). On the other hand, it was found that, if a solvent in which the resin contained in the liquid developer is soluble is added (Comparative Examples 1 and 2), then it is not possible to sufficiently promote aggregation of the resin, and cleaning of the intermediate transfer belt by the cleaning unit of the intermediate transfer belt is inadequate. Moreover, it was also found that if no liquid at all is applied before passing the cleaning unit of the intermediate transfer belt after secondary transfer (Comparative Example 3), then the cleaning of the intermediate transfer belt by the cleaning unit of the intermediate transfer belt is even more inadequate.

This application is based on Japanese Patent application No. 2010-278132 filed in Japan Patent Office on Dec. 14, 2010, the contents of which are hereby incorporated by reference.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an image bearing member, on a surface of which an electrostatic latent image is formed;

a developing apparatus which forms a coloring particle image in which the electrostatic latent image formed on the surface of the image bearing member is converted into a real image by using a liquid developer containing a carrier liquid, coloring particles dispersed in the carrier liquid, and resin dissolved in the carrier liquid;

a rotatable intermediate transfer body which is disposed so as to oppose the image bearing member;

a primary transfer unit which transfers the coloring particle image formed on the surface of the image bearing member to the intermediate transfer body;

a secondary transfer unit which transfers onto a recording medium the coloring particle image transferred to the intermediate transfer body;

a cleaning unit which recovers liquid developer remaining on the intermediate transfer body after transfer by the second transfer unit; and an aggregation promoting agent addition unit which is disposed on a downstream side of the secondary transfer unit in a direction of rotation of the intermediate transfer body and on an upstream side of the cleaning unit in a direction of rotation of the intermediate transfer body and which adds to the surface of the intermediate transfer body an aggregation promoting agent that promotes aggregation of resin contained in the liquid developer.

2. The image forming apparatus according to claim 1, wherein the resin is insoluble in the aggregation promoting agent.

3. The image forming apparatus according to claim 1, wherein the aggregation promoting agent is a liquid which is mutually compatible with the carrier liquid.

4. The image forming apparatus according to claim 1, wherein the carrier liquid contains at least a first solvent in which the resin is insoluble and a second solvent in which the resin is soluble; and the aggregation promoting agent is the first solvent.

5. The image forming apparatus according to claim 1, wherein the resin includes cellulose ether type resin;

the carrier liquid is a mixed solvent of a tall oil fatty acid and an aliphatic hydrocarbon; and the aggregation promoting agent is an aliphatic hydrocarbon.

6. The image forming apparatus according to claim 1, wherein the cellulose ether type resin is ethyl cellulose.

7. The image forming apparatus according to claim 1, wherein the resin includes cyclic olefin copolymer;

the carrier liquid is an aliphatic hydrocarbon; and the aggregation promoting agent is an alcohol solvent.

8. The image forming apparatus according to claim 7, wherein the cyclic olefin copolymer is a copolymer of norbornene and ethylene.

* * * * *